US005899154A

United States Patent [19]

Mizuno

[11] Patent Number: 5,899,154

[45] Date of Patent: May 4, 1999

[54] EMBROIDERY DATA PROCESSING APPARATUS FOR GENERATING STITCH DATA FOR CLOSED AREAS DEFINED BY A SELF INTERSECTING OUTLINE

[75] Inventor: Masahiro Mizuno, Nagoya, Japan

[73] Assignee: Brother Kogyo Kabushiki Kaisha, Nagoya, Japan

[21] Appl. No.: 08/990,816

[22] Filed: Dec. 15, 1997

[30] Foreign Application Priority Data

Dec. 18, 1996 [JP] Japan ..... 8-338163

[51] Int. Cl.[6] ..... D05C 5/02

[52] U.S. Cl. ..... 112/102.5; 364/470.09

[58] Field of Search ..... 112/102.5, 470.06, 112/475.19, 470.04, 454, 456, 458; 364/470.09, 470.07

[56] References Cited

U.S. PATENT DOCUMENTS 4,991,524 2/1991 Ozaki .

5,151,863 9/1992 Komuro et al. ..... 112/102.5 X 5,210,694 5/1993 Hayakawa ..... 112/102.5 X 5,320,054 6/1994 Asano ..... 112/103 X 5,576,968 11/1996 Mizuno et al. .

*Primary Examiner*—Peter Nerbun

*Attorney, Agent, or Firm*—Oliff & Berridge, PLC

[57] ABSTRACT

An embroidery data processing apparatus for generating stitch data whereby occurrence of segmental area-connecting thread is eliminated and the stitches are contained within a designated embroidery area. If an outline defining the external shape of an embroidery area has a self-intersecting portion, a dividing device divides the outline into a plurality of segmental outlines using the self-intersecting portion as a boundary. For each of the segmental closed areas defined by the segmental outlines, a segmental stitch data generating device generates segmental stitch data.

20 Claims, 15 Drawing Sheets

EMBROIDERY DATA PROCESSING APPARATUS FOR GENERATING STITCH DATA FOR CLOSED AREAS DEFINED BY A SELF INTERSECTING OUTLINE

BACKGROUND OF THE INVENTION

1. Field of the invention

The invention relates to an embroidery data processing apparatus capable of generating stitch data for producing embroidery stitching inside a closed area enclosed by an outline that defines the shape of an embroidery area.

2. Description of the Related Art

Stitch data for stitching an embroidery was conventionally generated by a skilled person determining the position coordinates of needle location point for each stitch. An embroidery data processing apparatus has recently been developed, which is able to semi-automatically generate stitch data for embroideries by defining an embroidery body that designates the shape, position, size, stitching direction, stitch density, and the like of an area to be embroidered. Such apparatuses are now widely used. A method for filling a closed area enclosed by an outline that defines the shape of an embroidery area, with stitches, disclosed in U.S. Pat. No. 4,991,524 and the like, is widely employed by ordinary embroidery data generating systems and the like.

However, the embroidery data generating method disclosed in U.S. Pat. No. 4,991,524 does not take into consideration a case where the outline defining the shape of an embroidery area intersects itself. Therefore, this conventional method sometimes generates inconvenient data that causes a stitch or a segmental area-connecting thread to extend out of the embroidery area.

SUMMARY OF THE INVENTION

Accordingly, it is an object of the invention to provide an embroidery data processing apparatus capable of generating stitch data whereby the occurrence of a segmental area-connecting thread is eliminated and the stitches are contained within a designated embroidery area.

According to the invention, there is provided an embroidery data processing apparatus for processing embroidery data for filling a closed area enclosed by an outline that defines a shape of an embroidery area, with stitches. The embroidery data processing apparatus includes a dividing device that, if the outline has a self-intersecting portion, divides the outline into a plurality of segmental outlines using the self-intersecting portion as a boundary. Furthermore, a segmental stitch data generating device generates segmental stitch data for each of the segmental closed areas defined by the plurality of segmental outlines.

If an outline defining the external shape of an embroidery area has a self-intersecting portion, the dividing device divides the outline into a plurality of segmental outlines using the self-intersecting portion as a boundary. For each of the segmental closed areas defined by the segmental outlines, the segmental stitch data generating device generates segmental stitch data. Therefore, even if the underlying stitch area outline intersects itself and defines a plurality of segmental closed areas, it is possible to easily generate stitch data whereby the segmental closed areas of an embroidery area are stitched without allowing a stitch or thread to extend out of the embroidery area, because stitch data is generated separately for the individual segmental closed areas.

The embroidery data processing apparatus may further include a setting device that sets a point at which the outline intersects itself, as one of a stitching start point and a stitching end point for the individual segmental closed areas. This optional arrangement further facilitates generation of stitch data that achieves efficient stitching of the segmental closed areas without allowing a stitch or thread to extend out of the embroidery area.

The embroidery data processing apparatus may further include a stitching sequence determining device that determines a stitching sequence of the segmental closed areas. Thereby, it becomes possible to generate stitch data for stitching the segmental closed areas in an efficient stitching sequence.

The embroidery data processing apparatus may further include an auxiliary stitch data generating device that generates auxiliary stitch data for continuously stitching the segmental closed areas. Thereby, it becomes possible to generate stitch data for continuously and efficiently stitching the segmental closed areas without allowing a stitch or thread to extend out of the embroidery area.

The embroidery data processing apparatus may further include a storage device that stores a connecting relationship between the segmental closed areas. Based on the connecting relationship between the segmental closed areas that is stored by the storage device, the auxiliary stitch data generating device generates auxiliary stitch data. This optional arrangement efficiently generates auxiliary stitching data for connecting two segmental closed areas that are not contiguous to each other, without allowing a stitch or thread to extend out of the embroidery area.

The auxiliary stitch data generated by the auxiliary stitch data generating device may include data regarding running stitches that extend at a given pitch through a point at which the outline intersects itself. Thereby, it becomes possible to generate auxiliary stitch data; for continuously stitching segmental closed areas, such as feed stitch (generally termed jump stitch) data or running stitch data whereby stitching extends at an appropriate pitch through a self-intersecting point of the outline.

BRIEF DESCRIPTION OF THE DRAWINGS

A preferred embodiment of the invention will be described in detail with reference to the following figures wherein.

DETAILED DESCRIPTION OF PREFERRED EMBODIMENT

Figure 1:
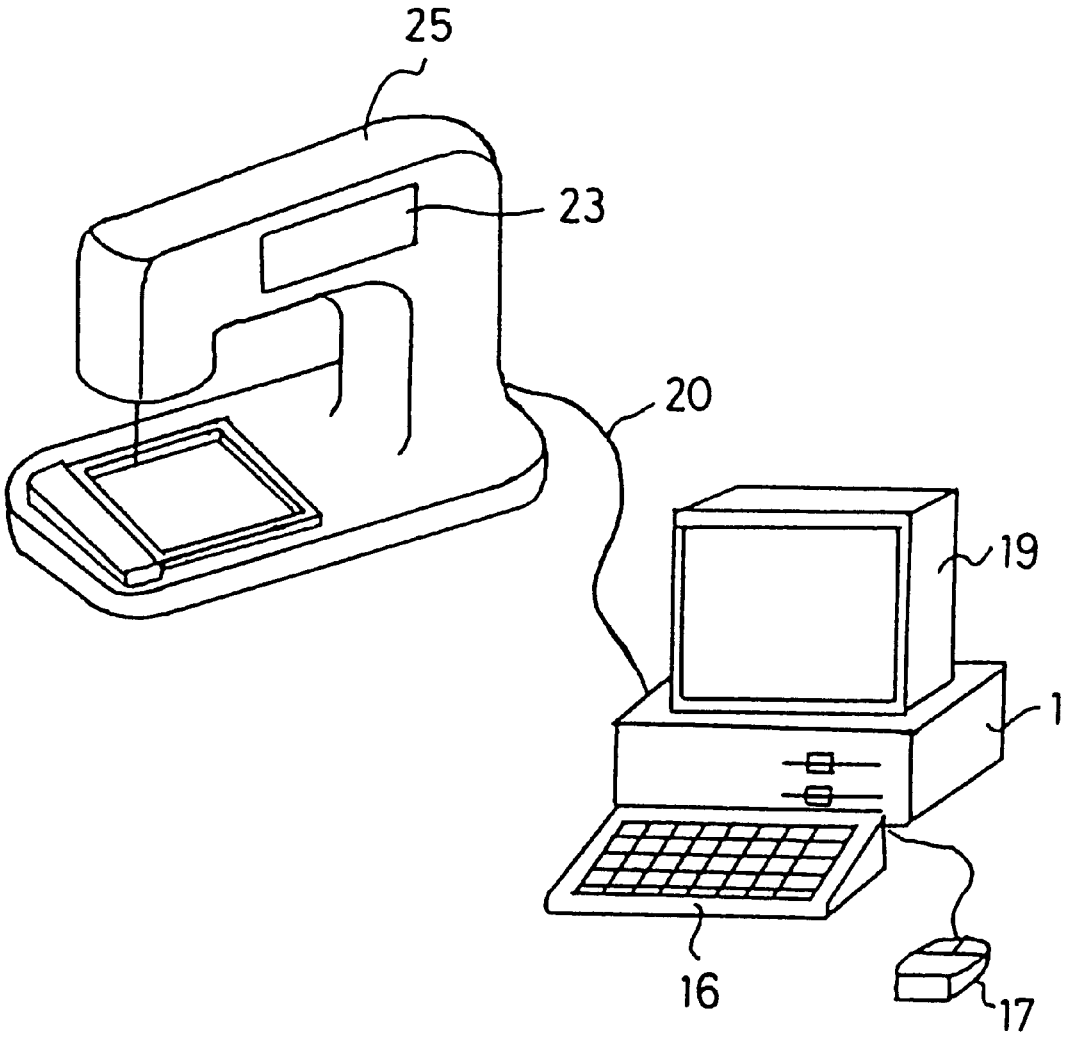
FIG. 1 is a perspective view of the overall arrangement of an embroidery sewing machine and an embroidery data processing apparatus according to an embodiment of the invention.

A preferred embodiment of the invention will be described in detail hereinafter with reference to the accompanying drawings.

An embroidery sewing machine used together with an embodiment of the embroidery data processing apparatus will be briefly described, although not detailed in the drawings. The embroidery sewing machine forms an embroidery pattern in a work cloth held by an embroidery frame disposed on an bed, by operating a horizontal motion mechanism to move the embroidery frame to predetermined positions indicated by the X–Y coordinate system provided specifically for the sewing machine while operating a sewing needle and a shuttle mechanism to stitch.

The horizontal motion mechanism, the needle bar and the like are controlled by a control device formed of a microcomputer and the like. The control device receives embroidering stitch (needle pierce) data that designates a displacement (needle pierce position) of the work cloth in the X and Y-directions for each stitch and, thereby, is able to automatically perform the embroidering operation. In this embodiment, the embroidery sewing machine is equipped with a communication device for receiving embroidery stitch data from an external device. An embroidery data processing apparatus of this embodiment has a function for generating such embroidery stitch data.

FIG. 1 shows the overall arrangement of a sewing machine and an embroidery data processing apparatus according to this embodiment. An embroidery sewing machine 25 is constructed to receive embroidery data from a personal computer 1 through a communication cable 20. The embroidery sewing machine 25 has a display 23 for displaying various messages, such as a message to instruct a user to change the embroidery thread to a different-color thread, and the like.

Figure 2:
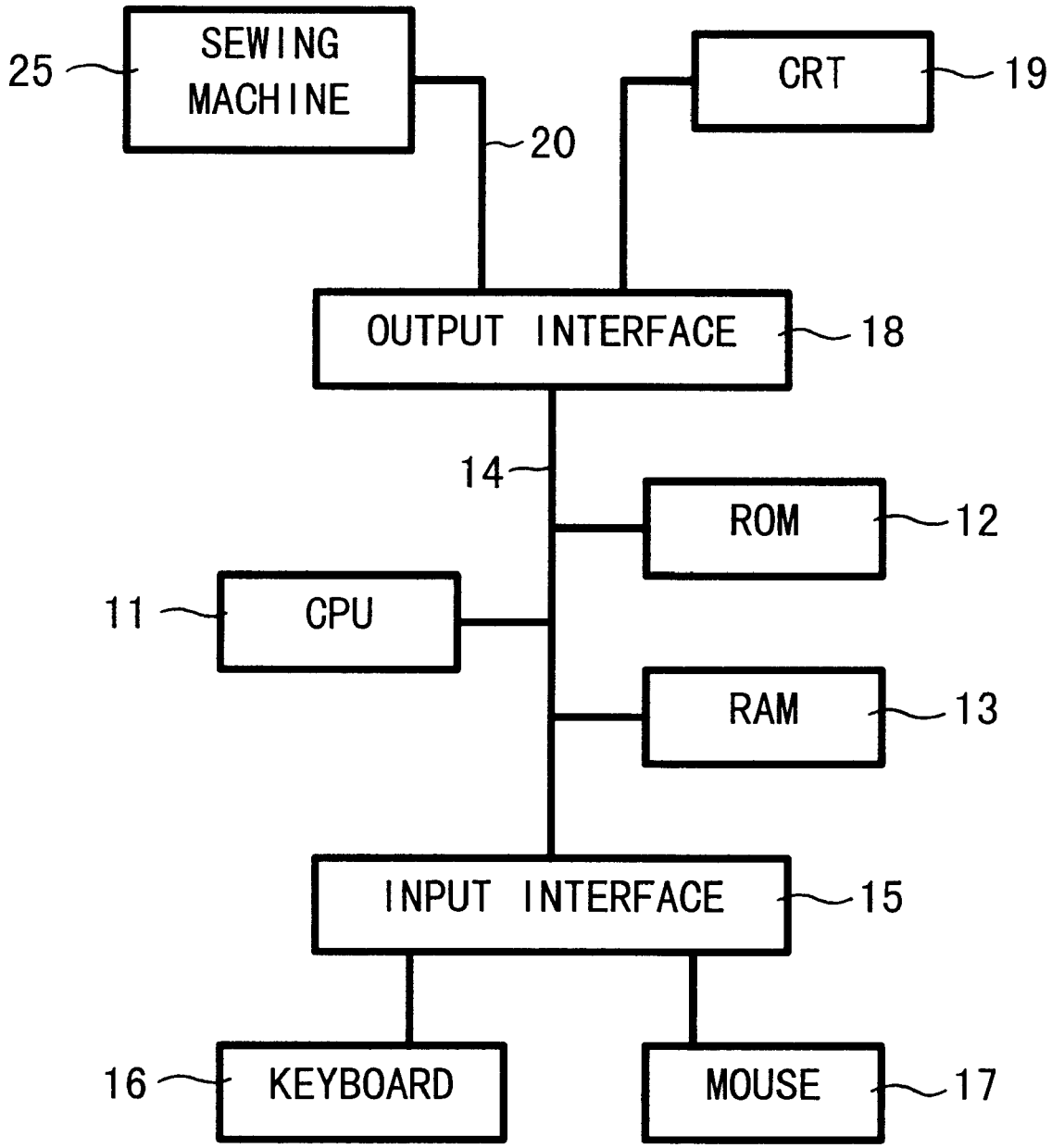
FIG. 2 is a block diagram illustrating the electrical arrangement of the embroidery data processing apparatus of the embodiment of the embodiment.

FIG. 2 illustrates the electrical arrangement of the embroidery data processing apparatus of this embodiment. The apparatus includes a (central processing unit) CPU 11, a read-only memory (ROM) 12, a random-access memory (RAM) 13, an input interface 15 and an output interface 18 which are interconnected by a bus 14. The CPU 11 performs control of the entire embroidery data processing apparatus while transmitting and receiving various data and signals. The ROM 12 stores programs and data for control of the embroidery data processing apparatus. The RAM 13 erasably stores data to be inputted from a keyboard 16 or an external storage device.

The embroidery data processing apparatus is equipped with a cathode-ray tube (CRT) display 19 connected to the output interface 18. The CRT display 19 displays various graphics indicating the shapes of embroidery patterns, various messages, and the like.

The keyboard 16 and a mouse 17 are connected to the CPU 11, via the input interface 15. The keyboard 16 has an arrangement of operating keys for a user to input instructions, such as selection of an operation, execution of an operation, and the like. The mouse 17 is a pointing device for, for example, producing or selecting an outline that defines an embroidery shape on the CRT display 19.

The communication cable 20 is connected to the embroidery data processing apparatus by the output interface 18. The embroidery data processing apparatus transmits generated embroidery data to the embroidery sewing machine 25 through the communication cable 20.

The operation of the embroidery data processing apparatus of this embodiment will be described with reference to the flowchart of FIG. 3.

When the program stored in the ROM 12 for generating embroidery data is started, the CPU 11 stores outline data inputted by a user, into the RAM 13 in step S1.

In step S2, the CPU 11 stores into the RAM 13 the positions of a stitching start point S and a stitching end point E that are inputted by the user. In the description of this embodiment, it is assumed that stitch data is generated for filling a closed area enclosed by an outline L shown in FIG. 4A, with stitches.

In step S3, the CPU 11 extracts self-intersecting points P1, P2 in the outline L. The "self-intersecting point" used in this application means a point at which a single, or continuous, outline intersects itself.

Figure 4A:
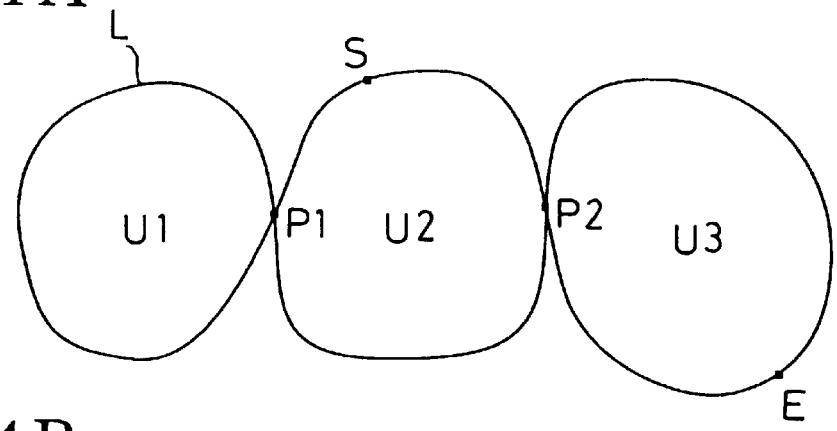
FIGS. 4A–4D illustrate a processing method for generating stitch data performed by the embroidery data processing apparatus of the embodiment.
Figure 8:
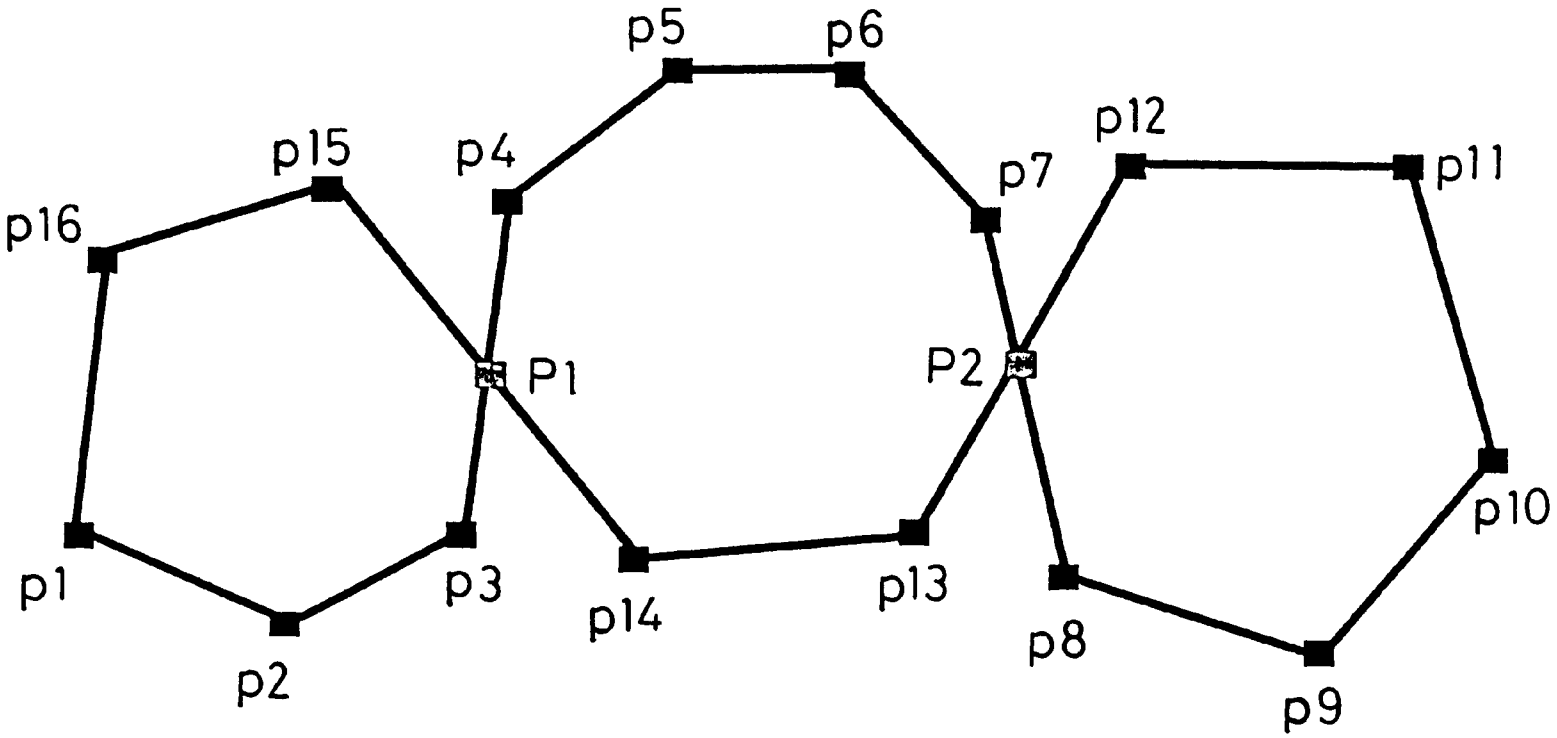
FIG. 8 shows an outline defining a plurality of segmental closed areas, and points that define the outline.
Figure 9:
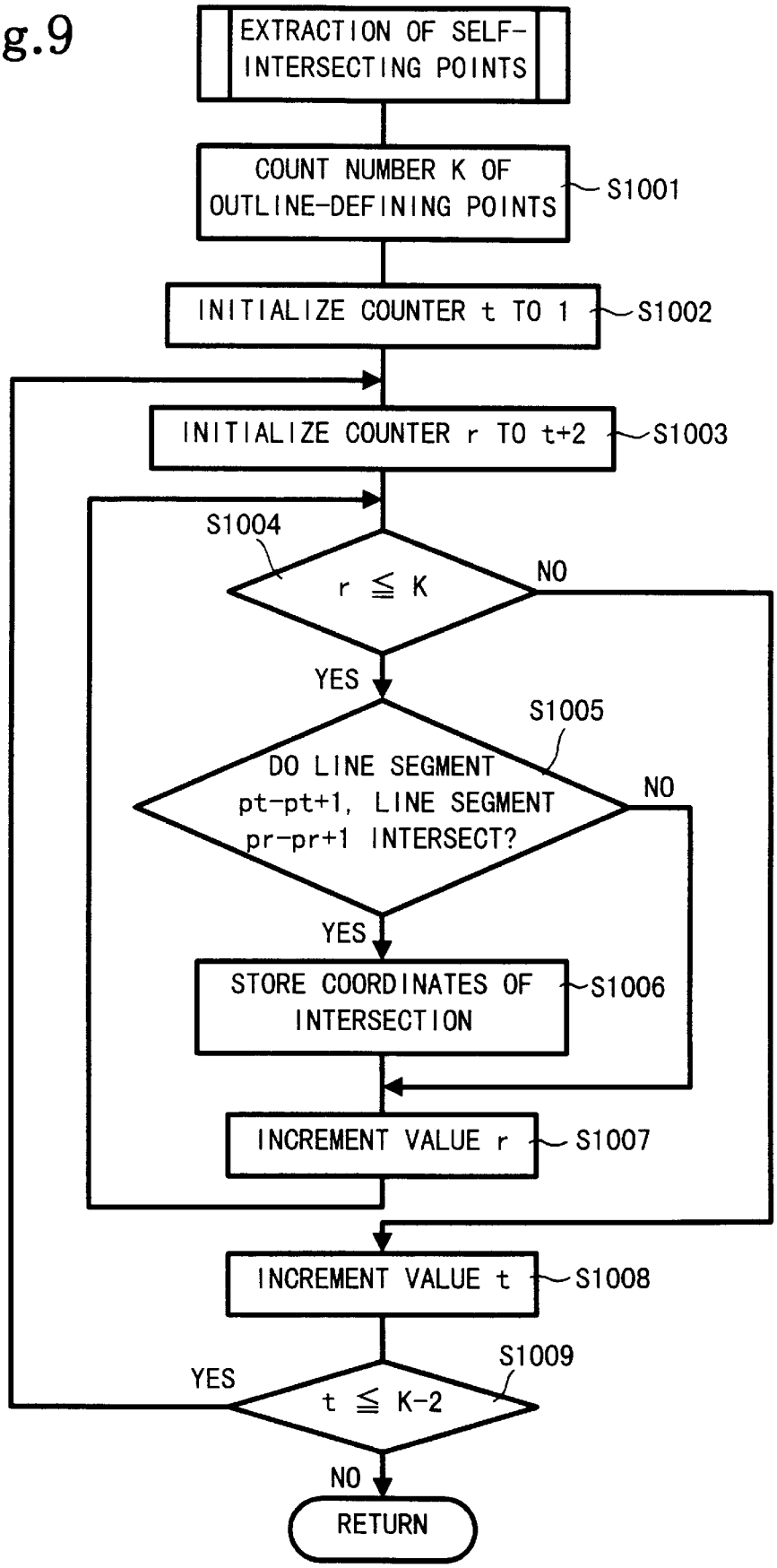
FIG. 9 is a flowchart illustrating an operation of extracting self-intersecting points.

The operation of extracting self-intersecting points in step S3 will be described in detail with reference to the flowchart of FIG. 9. It is assumed that the outline L shown in FIG. 4A is a bent outline, as shown in FIG. 8, formed by serially connecting outline-defining points p1–p16.

In step S1001, the number K of points defining the outline L is counted. In the example shown in FIG. 8, the number K is 16.

In step S1002, a counter t is initialized to 1.

In step S1003, a counter r is initialized to t+2 (that is, 3 in this case).

In step S1004, it is determined whether the value of the counter r is equal to or less than the number K of the outline-defining points. Since the value r is presently 3 and the number K is presently 16, the determination in step S1004 is YES, and the operation proceeds to step S1005.

In step S1005, it is determined whether a line segment of pt to pt+1 and a line segment of pr to pr+1 intersect each other. In the present stage, it is determined whether the line segment of p1 to p2 and the line segment of p3 to p4 intersect. Because the line segment of p1–p2 and the line segment of p3–p4 do not intersect as can be seen in FIG. 8, the determination in step S1005 is NO, and the operation jumps to step S1007.

In step S1007, the value of the counter r is incremented (r=4). The operation subsequently returns to step S1004. Similar processing is repeated until the value of the counter r exceeds the number K (=16) of the outline-defining points. When it is determined in step S1004 that the counter value r has exceeded the number K (No in step S1004), the operation proceeds to step S1008.

In step S1008, the value of the counter t is incremented (t=2).

Subsequently, in step S1009, it is determined whether the value of the counter t is equal to or less than the value obtained by subtracting 2 from the number K of the outline-defining points. Since the value t presently equals 2 and the value (K−2) presently equals 14, the determination in step S1009 is YES, and the operation returns to step S1003.

A similar operation is continued until the value of the counter t is 3 and the value of the counter r is 14. Since the line segment p3–p4 and the line segment p14–p15 intersect, the determination in step S1005 is YES, and the operation proceeds to step S1006.

In step S1006, the coordinates of the intersecting point between the line segment p3–p4 and the line segment p14–p15 are determined, and stored into the RAM 13. That is, the coordinates of the self-intersecting point P1 of the outline L shown in FIGS. 4A and 8 are extracted. The operation then proceeds to step S1007.

When the value of the counter t is 7 and the value of the counter r is 12, after processing similar to that described above, the determination in step S1005 is again YES because the line segment p7–p8 and the line segment p12–p13 intersect. The operation then proceeds to step S1006.

In step S1006, the coordinates of the intersecting point between the line segment p7–p8 and the line segment p12–p13 are determined, and stored into the RAM 13. That is, the coordinates of the self-intersecting point P2 of the outline L shown in FIGS. 4A and 8 are extracted. The operation then proceeds to step S1007.

Similar processing continues until the value of the counter t becomes 15. Since the value t (15) is now greater than the value (K−2) (that is, 14), the determination in step S1009 is NO.

It is to be noted that when r=K, then pt+1 would be undefined, i.e., non-existent point p17 in this example. Thus, the routine uses p1 which is the next point on the outline as pt+1.

The extraction of self-intersecting points in the outline L is thus completed by the operation of steps S1001–S1009. The operation then goes to step S4 in FIG. 3.

In step S4, the CPU 11 divides the outline L at the self-intersecting points P1, P2 into a plurality of segmental outlines, and sets segmental closed areas U1, U2 and U3 enclosed by the segmental outlines as shown in FIG. 4A.

In step S5, the CPU 11 sets the total number N of segmental closed areas set in step S4, to 3.

Figure 10:
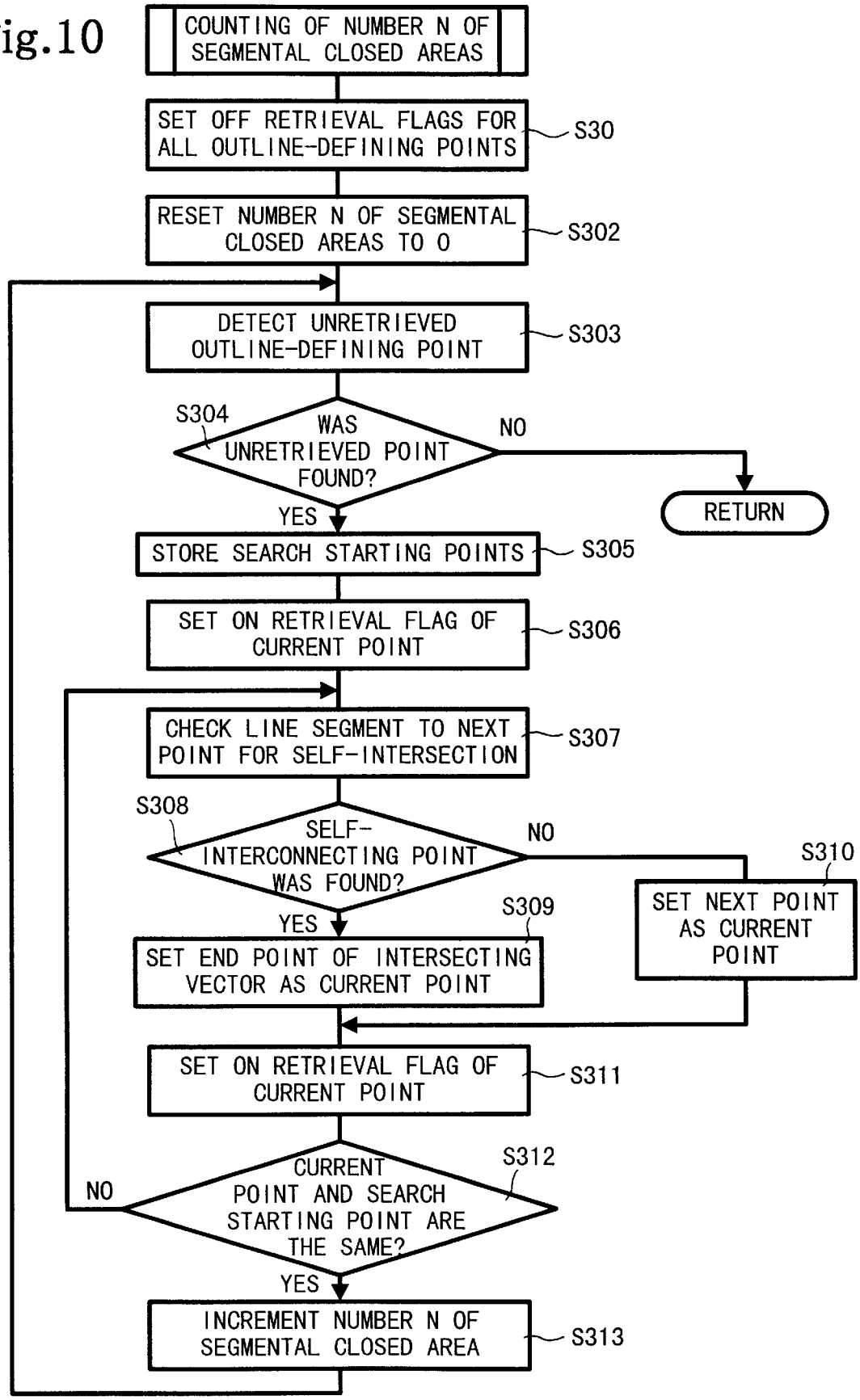
FIG. 10 is a flowchart illustrating an operation of counting the number of segmental closed areas.

The operation of counting the total number N of segmental closed areas of step S5 will be described in detail with reference to the flowchart of FIG. 10. It is assumed that the outline L shown in FIG. 4A is a bent outline, formed by serially connecting outline-defining points p1–p16, as shown in FIG. 8.

In step S301, flags indicating retrieval of the individual points defining the outline L for self-intersection search are set to "OFF" (indicating unretrieved). A flag is set to "ON" when the corresponding outline-defining point is retrieved for self-intersection search in a later stage of the operation.

In step S302, the total number N of segmental closed areas is reset to 0.

In step S303, an unretrieved outline-defining point, that is, a point that has not been retrieved for self-intersection search, is searched for. Specifically, an outline-defining point with the corresponding flag being "OFF" is searched for, by serially checking the retrieval flags in the sequence of the flags of the points p1 through p16. In the present stage, the point p1 is first detected as an unretrieved outline-defining point.

In step S304, it is determined whether an unretrieved outline-defining point has been found in step S303. Because the point p1 was found as an unretrieved point, and therefore extracted in step S303 in the present stage, the determination in step S304 is YES, and the operation proceeds to step S305.

In step S305, the outline-defining point retrieved in step S303 is stored into the RAM 13 as a search starting point S for the purpose of counting the number of segmental closed areas. In the present stage, the point p1 is stored into the RAM 13 as a search starting point. The point p1 is treated as a current point for self-intersection search.

In step S306, the retrieval flag of the point p1, which is the current point, is set to "ON" (indicating retrieved).

In step S307, the line segment from the current point p1 to the next point p2 is checked for the presence of a self-intersecting point of the outline L.

In step S308, it is determined whether a self-intersecting point of the outline L was found in the line segment presently concerned in step S307. In the present stage, the determination in step S308 is NO because the line segment p1–p2 does not have a self-intersecting point of the outline L as indicated in FIG. 8. The operation then goes to step S310.

In step S310, the point p2, which is the next point, is set as a current point.

In step S311, the retrieval flag of the current point, that is, the point p2, is set to "ON" (indicating retrieved).

In step S312, it is determined whether the current point and the search starting point S are one and the same point. Since the current point p2 for the search and the search starting point p1 are not the same, the determination in step S312 is NO, and the operation returns to step S307.

Similar processing continues until the current and next points for search become the point p3 and the point p4, respectively. In step S307, the line segment p3–p4 is checked for the presence of a self-intersecting point of the outline L. Since the line segment p3–p4 has a self-intersecting point P1 of the outline L, as indicated in FIG. 8, the presence of the self-intersecting point P1 is confirmed in step S307. The determination in step S308 therefore is YES, and the operation proceeds to step S309.

In step S309, the end point of the vector (line segment) intersecting with the presently-concerned line segment at the self-intersecting point of the outline L is set as a current point. In the present stage, the end point p15 of the vector p14–p15 intersecting with the concerned line segment p3–p4 is set as a current point for the next search for an self-intersecting point.

In step S311, the retrieval flag of the current point p15 for search is set to "ON".

Because the current point p15 and the search starting point p1 are not the same, the determination in step S312 is NO, and the operation returns to step S307.

Similar processing continues until step S310 sets the point p1 as a current point for search, which occurs after the current and next points for search have been set to the point p16 and the point p1. In step S312, it is determined that the current point p1 for search and the search starting point p1 are the same point. The operation then proceeds to step S313.

In step S313, the number N of segmental closed areas (N=0) is incremented (to N=1). The operation then returns to step S303.

In step S303, an unretrieved outline-defining point is searched for. In the present stage, the point p4 is detected and extracted as an unretrieved point because the point p4 is the first point with the corresponding retrieval flag being "OFF" that is detected by serially checking the retrieval flags of outline-defining points in the sequence of the flags of points p1 toward p16.

In step S305, the point p4 is set as a search starting point.

Similar processing continues until the current and next points for search become the point p7 and the point p8, respectively. As the line segment p7–p8 has a self-intersecting point P2 of the outline L, as indicated in FIG. 8, the presence of the self-intersecting point P2 on the line segment p7–p8 is confirmed in step S307. The determination in step S308 therefore is YES, and the operation proceeds to step S309.

In step S309, the end point p13 of the vector p12–p13 intersecting the line segment p7–p8 is set as a new current point. The subsequent operation is continued.

Similar processing continues until the current and next points for search become the point p14 and the point p15, respectively. Since the line segment p14–p15 has the self-intersecting point P1 of the outline L as indicated in FIG. 8, the presence of the self-intersecting point P1 on the line segment p14–p15 is confirmed in step S307. The determination in step S308 therefore is YES, and the operation proceeds to step S309.

In step S309, the end point p4 of the vector p3–p4 intersecting the line segment p14–p15 is set as a new current point.

In step S312, it is determined that the current point p4 and the search starting point p4 are the same point. The operation then proceeds to step S313.

In step S313, the number N of segmental closed areas (N=1) is incremented (to N=2). The operation then returns to step S303.

In step S303, an unretrieved outline-defining point is searched for. In the present stage, the point p8 is detected and extracted as an unretrieved point because the point p8 is the first point with the corresponding retrieval flag being "OFF" that is detected by serially checking the retrieval flags of outline-defining points in the sequence of the flags of points p1 toward p16.

In step S305, the point p8 is set as a search starting point.

Processing similar to that described above continues until the current and next points for search become the point p12 and the point p13, respectively. In step S307, it is confirmed that the self-intersecting point P2 of the outline L is present on the line segment p12–p13 is confirmed. Therefore, the determination in step S308 is YES.

In step S309, the end point p8 of the vector p7–p8 intersecting the line segment p12–p13 is set as a new current point.

After the retrieval flag of the current point p8 is set to "ON" in step S311, it is determined in step S312 that the current point p8 and the search starting point p8 are the same point, and the operation proceeds to step S313.

In step S313, the number N of segmental closed areas (N=2) is incremented (to N=3). The operation then returns to step S303.

As the retrieval flags of all the outline-defining points p1–p16 have been set to "ON", an unretrieved outline-defining point cannot be detected in step S303. Therefore, the determination in step S304 is NO, and the operation goes to step S6 in FIG. 3.

The number N (=3) of segmental closed areas is thus counted by the operation of steps S301 to S313.

Figure 3:
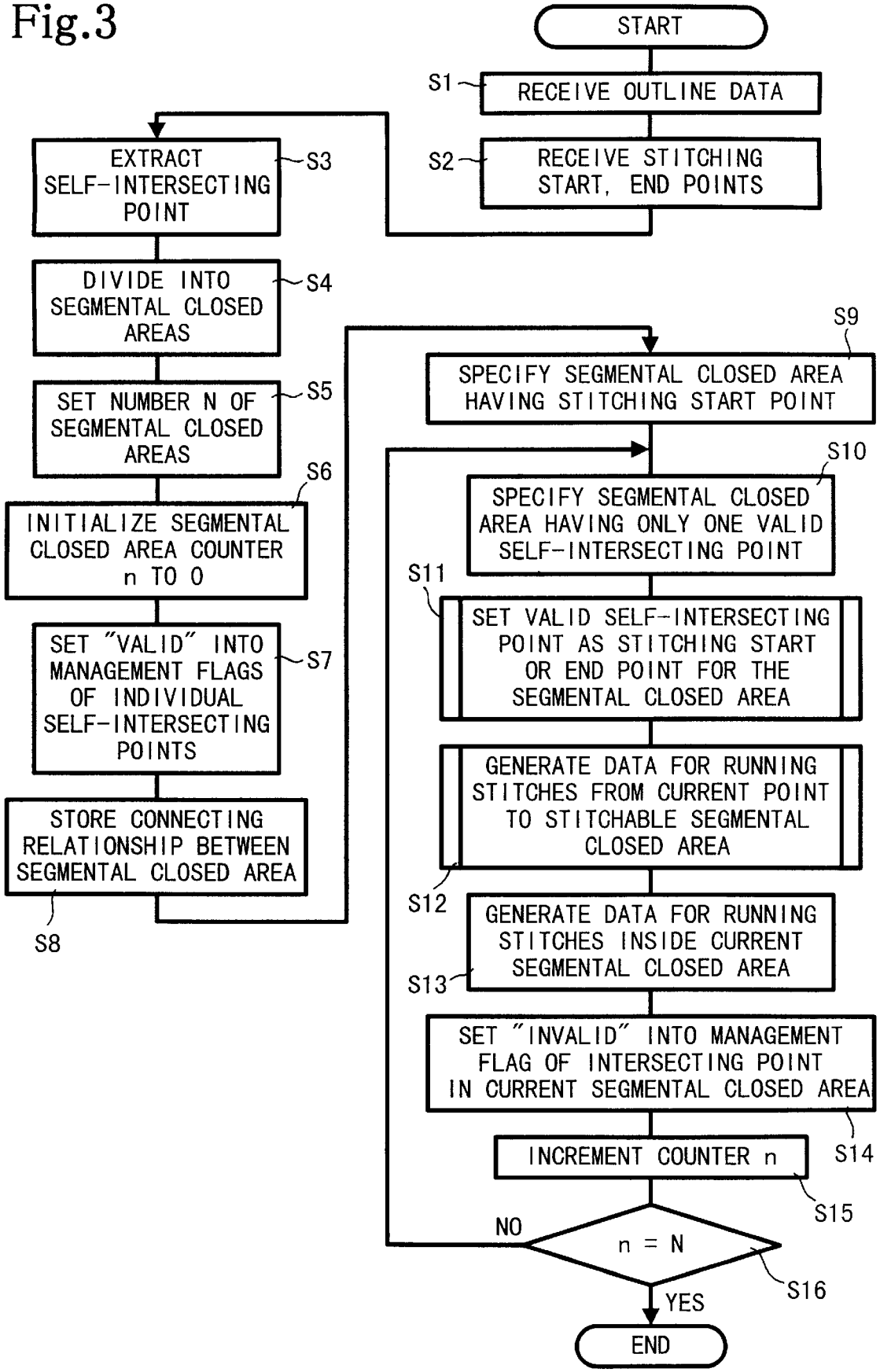
FIG. 3 is a flowchart illustrating an example of the stitch data generating operation performed by the embroidery data processing apparatus of the embodiment.

In step S6 in FIG. 3, the value of a segmental closed area counter n is initialized to 0.

In step S7, management flags for the individual self-intersecting points of the outline L are set to "VALID". That is, initial setting is made indicating that all the self-intersecting points are valid self-intersecting points.

Figure 5A:
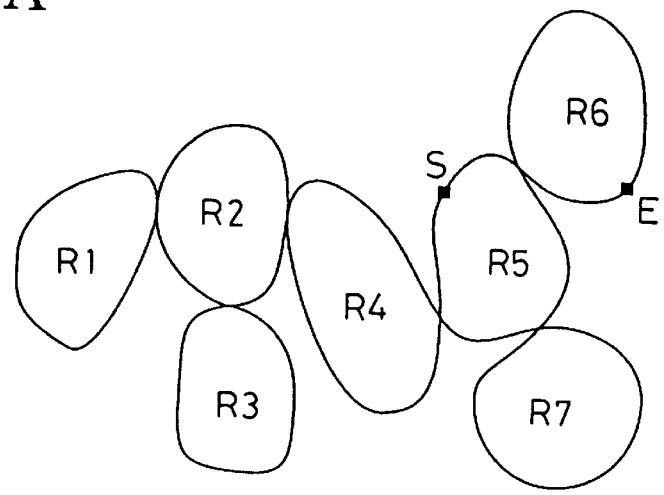
FIGS. 5A–5C illustrate a processing method for generating stitch data performed by the embroidery data processing apparatus of the embodiment.
Figure 5B:
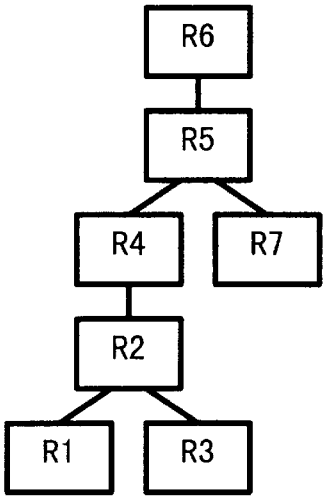
Figure 12:
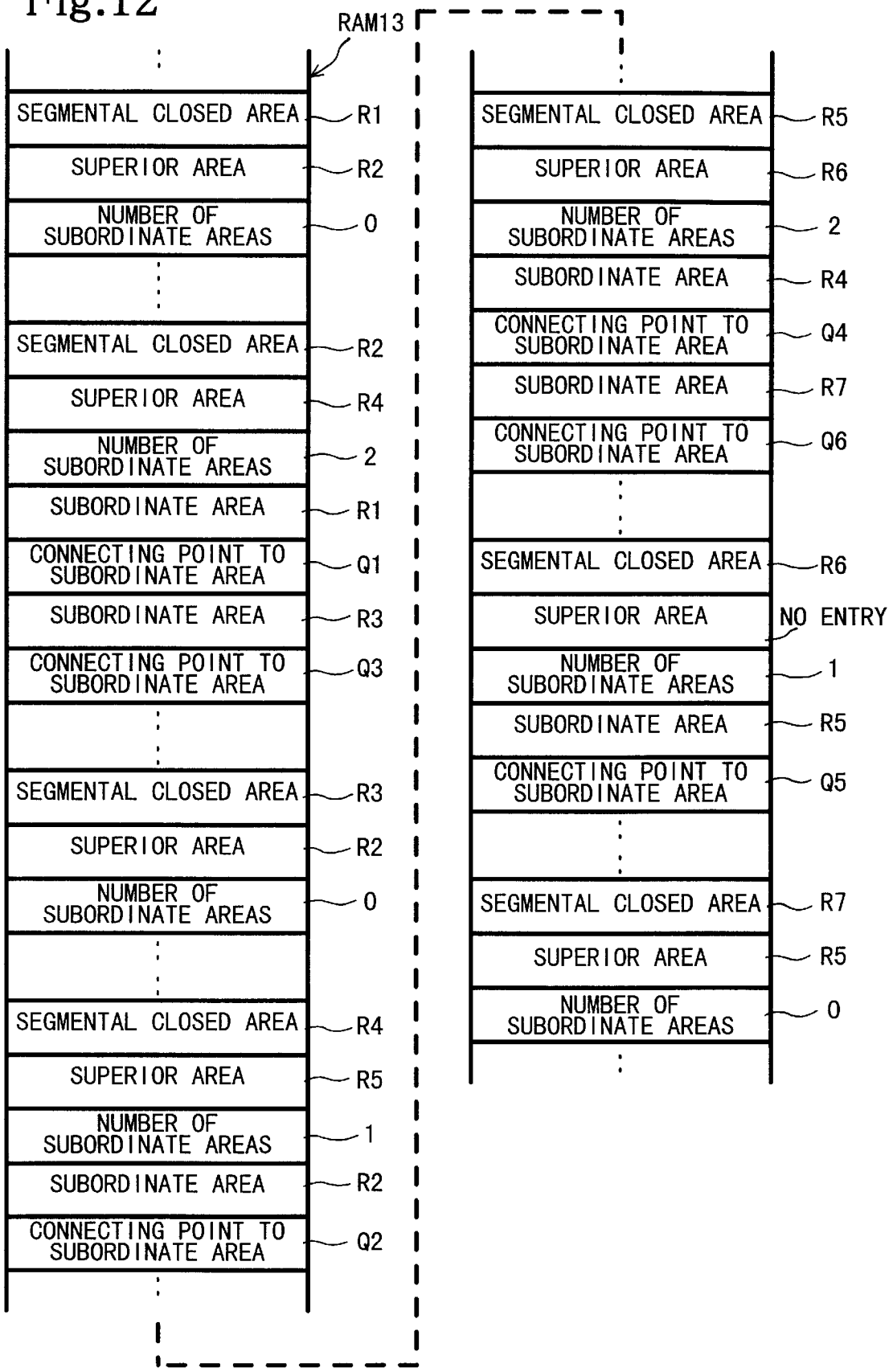
FIG. 12 illustrates a storage structure of the connecting relationship among segmental closed areas in the RAM.
Figure 14:
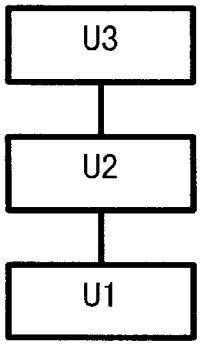
FIG. 14 indicates the connecting relationship among segmental closed areas.

In step S8, a connecting relationship among the segmental closed areas set in step S4 is stored. That is, a connecting relationship among the segmental closed areas is established in a hierarchical structure in which the segmental area U3, having the stitching end point E pre-set by the user, is placed on the top, or apex, of the hierarchy. This will be described in detail in conjunction with an example case shown in FIG. 5A, where there are segmental closed areas R1–R7. For this example case, a connecting relationship is constructed in which the segmental area having the stitching end point E is placed on the top as indicated in FIG. 5B and stored into the RAM 13 as shown in FIG. 12. For the segmental closed areas U1, U2 and U3 shown in FIG. 4A, a connecting relationship in which the area U3 is connected to the area U2 is constructed as indicated in FIG. 14.

Figure 5C:
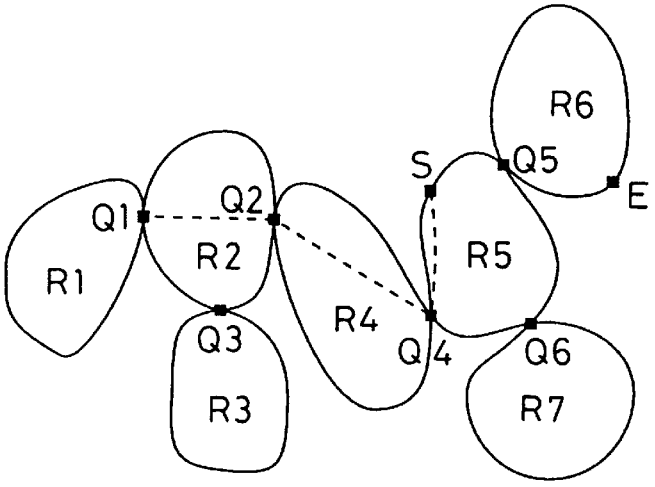
Figure 11:
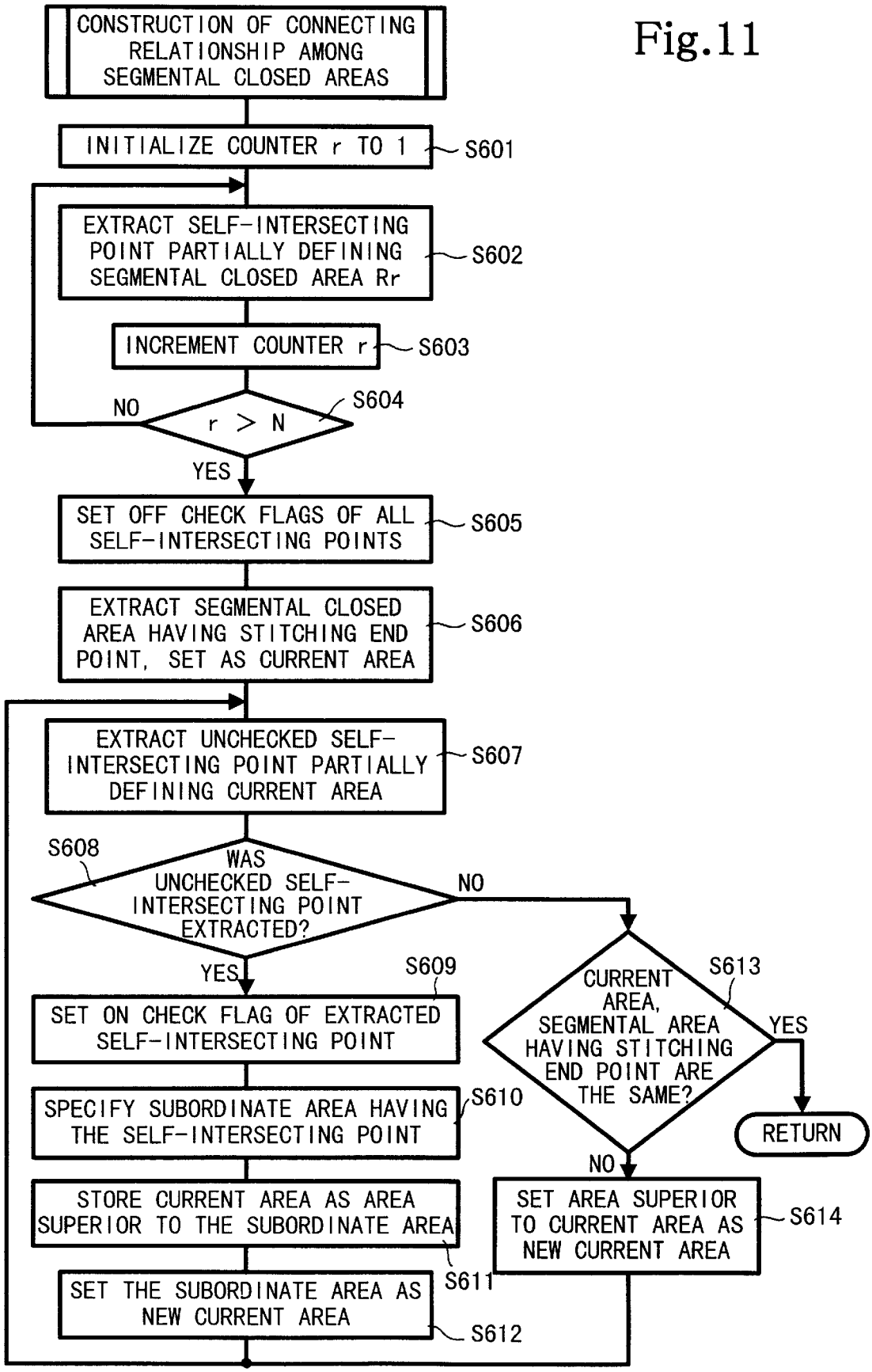
FIG. 11 is a flowchart illustrating an operation of constructing a connecting relationship among segmental closed areas.

The operation of constructing a connecting relationship among segmental closed areas in step S8 will be described in detail with reference to the flowchart of FIG. 11, in conjunction with the example case shown in FIGS. 5A–5C.

In step S601, the value of a counter r is initialized to 1.

In step S602, an outline self-intersecting point forming a segmental outline enclosing a segmental closed area Rr is extracted. In the present stage, a self-intersecting point Q1 forming a segmental outline enclosing a segmental closed area R1 is extracted.

In step S603, the value of the counter r (=1) is incremented (to r=2).

In step S604, it is determined whether the value of the counter r (=1) is greater than the number N (=7) of segmental closed areas. In the present stage, the determination in step S604 is NO, and the operation returns to step S602.

Through similar processing, self-intersecting points Q1, Q2 are extracted as self-intersecting points forming a segmental outline enclosing a segmental closed area R2. A self-intersecting point Q3 is extracted as a self-intersecting point forming a segmental outline enclosing a segmental closed area R3. Self-intersecting points Q2, Q4 are extracted as self-intersecting points forming a segmental outline enclosing a segmental closed area R4. Self-intersecting points Q4, Q5, Q6 are extracted as self-intersecting points forming a segmental outline enclosing a segmental closed area R5. A self-intersecting point Q5 is extracted as a self-intersecting point forming a segmental outline enclosing a segmental closed area R6. A self-intersecting point Q6 is extracted as a self-intersecting point forming a segmental outline enclosing a segmental closed area R7. Then, the counter value r (=7) is incremented (to r=8) in step S603.

In step S604, it is determined that the counter value r (=8) is greater than the number N (=7) of segmental closed areas. The operation therefore proceeds to step S605.

In step S605, check flags for the individual self-intersecting points are set to "OFF" (indicating unchecked).

In step S606, a segmental closed area that has the stitching end point is extracted. In the example case, the segmental closed area R6, having the stitching end point E, is extracted, and set as a current area.

In step S607, an unchecked self-intersecting point forming a segmental outline enclosing the current area is extracted if any. In the present stage, the self-intersecting point Q5 forming the segmental outline enclosing the segmental closed area R6 has not been checked, so that the self-intersecting point Q5 is extracted.

In step S608, it is determined whether an unchecked self-intersecting point was extracted in step S607. In the present stage, since the self-intersecting point Q5 was extracted in step S607, the determination in step S608 is YES, and the operation proceeds to step S609.

In step S609, the check flag of the extracted self-intersecting point Q5 is set to "ON" (indicating checked).

In step S610, another segmental closed area that has the self-intersecting point Q5, other than the current area, is specified as an area subordinate to the current area. In the present stage, the segmental closed area R5 is extracted as another segmental closed area that has the self-intersecting point Q5, and specified as an area subordinate to the current area, that is, the segmental closed area R6.

In step S611, the current area is set as an area superior to the segmental closed area that has been specified as an area subordinate to the current area. In the present stage, the segmental closed area R6 is set as an area superior to the segmental closed area R5. This relationship is stored into the RAM 13.

In step S612, the segmental closed area specified as an area subordinate to the current area is set as a new current area. In the present stage, the segmental closed area R5 becomes a new current area. The operation then returns to step S607.

In step S607, it is assumed that the self-intersecting point Q4 is extracted as an unchecked self-intersecting point forming the segmental outline enclosing the current area R5 although among the check flags of the three self-intersecting points Q4, Q5, Q6 partially defining the current area R5, the check flags of the two points Q4 and Q6 have been "OFF" (indicating unchecked).

The determination in step S608 is YES because the self-intersecting point Q4 was extracted in step S607. The operation then proceeds to step S609.

In step S609, the check flag of the extracted self-intersecting point Q4 is set to "ON" (indicating checked).

In step S610, the segmental closed area R4 is extracted as another segmental closed area that has the self-intersecting point Q4, and the area R4 is specified as an area subordinate to the current area, that is, the segmental closed area R5.

In step S611, the segmental closed area R5 is set as an area superior to the segmental closed area R4, and this relationship is stored into the RAM 13.

In step S612, the segmental closed area R4 is set as a new current area. The operation then returns to step S607.

In step S607, the self-intersecting point Q2 is extracted as an unchecked self-intersecting point forming the segmental outline enclosing the current area R4.

The determination in step S608 is YES because the self-intersecting point Q2 was extracted in step S607. The operation then proceeds to step S609.

In step S609, the check flag of the extracted self-intersecting point Q2 is set to "ON" (indicating checked).

In step S610, the segmental closed area R2 is extracted as another segmental closed area that has the self-intersecting point Q2, and the area R2 is specified as an area subordinate to the current area, that is, the segmental closed area R4.

In step S611, the segmental closed area R4 is set as an area superior to the segmental closed area R2, and this relationship is stored into the RAM 13.

In step S612, the segmental closed area R2 is set as a new current area. The operation then returns to step S607.

In step S607, it is assumed that the self-intersecting point Q1 is extracted as an unchecked self-intersecting point forming the segmental outline enclosing the current area R2 although among the check flags of the three self-intersecting points Q1, Q2, Q3 partially defining the current area R2, the check flags of the two points Q1 and Q3 have been "OFF" (indicating unchecked).

The determination in step S608 is YES because the self-intersecting point Q1 was extracted in step S607. The operation then proceeds to step S609.

In step S609, the check flag of the extracted self-intersecting point Q1 is set to "ON" (indicating checked).

In step S610, the segmental closed area R1 is extracted as another segmental closed area that has the self-intersecting point Q1, and the area R1 is specified as an area subordinate to the current area, that is, the segmental closed area R2.

In step S611, the segmental closed area R2 is set as an area superior to the segmental closed area R1, and this relationship is stored into the RAM 13.

In step S612, the segmental closed area R1 is set as a new current area. The operation then returns to step S607.

Since the self-intersecting point Q1 is the only one self-intersecting point partially defining the segmental closed area R1 and has been checked in the processing up to the present moment, no unchecked self-intersecting point concerned is extracted in step S607.

The determination in step S608 is NO because no self-intersecting point was extracted in step S607. The operation then jumps to step S613.

In step S613, it is determined whether the current area and the segmental closed area having the stitching end point are one and the same area. In the present stage, the current area R1 is not the same as the segmental closed area R6 having the stitching end point E, so that the determination in step S613 is NO. The operation then proceeds to step S614.

In step S614, the segmental closed area set as an area superior to the current area is set as a new current area. In the present stage, the segmental closed area R2, which has been set as an area superior to the current area R1, is set as a new current area. The operation then returns to step S607.

In step S607, among the three self-intersecting points Q1, Q2, Q3 forming the segmental outline defining the current area R2, the self-intersecting point Q3, whose check flag is "OFF", is extracted.

The determination in step S608 is YES because the self-intersecting point Q3 was extracted in step S607. The operation then proceeds to step S609.

In step S609, the check flag of the extracted self-intersecting point Q2 is set to "ON" (indicating checked).

In step S610, the segmental closed area R3 is extracted as another segmental closed area that has the self-intersecting point Q3, and the area R3 is specified as an area subordinate to the current area, that is, the segmental closed area R2.

In step S611, the segmental closed area R2 is set as an area superior to the segmental closed area R3, and this relationship is stored into the RAM 13.

In step S612, the segmental closed area R3 is set as a new current area. The operation then returns to step S607.

Because the self-intersecting point Q3 is the only one self-intersecting point partially defining the segmental closed area R3 and has been checked in the processing up to the present moment, no unchecked self-intersecting point concerned is extracted in step S607.

The determination in step S608 is NO because no self-intersecting point was extracted in step S607. The operation then jumps to step S613.

In step S613, it is determined whether the current area and the segmental closed area having the stitching end point are one and the same area. In the present stage, the current area R3 is not the same as the segmental closed area R6 having the stitching end point E, so that the determination in step S613 is NO. The operation then proceeds to step S614.

In step S614, the segmental closed area set as an area superior to the current area is set as a new current area. In the present stage, the segmental closed area R2, which has been set as an area superior to the current area R3, is set as a new current area. The operation then returns to step S607.

As all of the self-intersecting points Q1, Q2, Q3 partially defining the segmental closed area R2 have been checked in the processing up to the present moment, no unchecked self-intersecting point is extracted in step S607.

The determination in step S608 is NO because no self-intersecting point was extracted in step S607. The operation then jumps to step S613.

In step S613, it is determined whether the current area and the segmental closed area having the stitching end point are one and the same area. In the present stage, the current area R2 is not the same as the segmental closed area R6 having the stitching end point E, so that the determination in step S613 is NO. The operation then proceeds to step S614.

In step S614, the segmental closed area set as an area superior to the current area is set as a new current area. In the present stage, the segmental closed area R4, which has been set as an area superior to the current area R2, is set as a new current area. The operation then returns to step S607.

As all of the self-intersecting points Q2, Q4 partially defining the segmental closed area R4 have been checked in the processing up to the present moment, no unchecked self-intersecting point concerned is extracted in step S607.

The determination in step S608 is NO because no self-intersecting point was extracted in step S607. The operation then jumps to step S613.

In step S613, it is determined whether the current area and the segmental closed area having the stitching end point are one and the same area. In the present stage, the current area R4 is not the same as the segmental closed area R6 having the stitching end point E, so that the determination in step S613 is NO. The operation then proceeds to step S614.

In step S614, the segmental closed area set as an area superior to the current area is set as a new current area. In the present stage, the segmental closed area R5, which has been set as an area superior to the current area R4, is set as a new current area. The operation then returns to step S607.

In step S607, the self-intersecting point Q6 is extracted as an unchecked self-intersecting point forming the segmental outline enclosing the current area R5.

The determination in step S608 is YES because the self-intersecting point Q6 was extracted in step S607. The operation then proceeds to step S609.

In step S609, the check flag of the extracted self-intersecting point Q6 is set to "ON" (indicating checked).

In step S610, the segmental closed area R7 is extracted as another segmental closed area that has the self-intersecting point Q6, and the area R7 is specified as an area subordinate to the current area, that is, the segmental closed area R5.

In step S611, the segmental closed area R5 is set as an area superior to the segmental closed area R7, and this relationship is stored into the RAM 13.

In step S612, the segmental closed area R7 is set as a new current area. The operation then returns to step S607.

Because the self-intersecting point Q6 is the only one self-intersecting point partially defining the segmental closed area R7 and has been checked in the processing up to the present moment, no unchecked self-intersecting point concerned is extracted in step S607.

The determination in step S608 is NO because no self-intersecting point was extracted in step S607. The operation then jumps to step S613.

In step S613, it is determined whether the current area and the segmental closed area having the stitching end point are one and the same area. In the present stage, the current area R7 is not the same as the segmental closed area R6 having the stitching end point E, so that the determination in step S613 is NO. The operation then proceeds to step S614.

In step S614, the segmental closed area set as an area superior to the current area is set as a new current area. In the present stage, the segmental closed area R5, which has been set as an area superior to the current area R7, is set as a new current area. The operation then returns to step S607.

As all of the self-intersecting points Q4, Q5, Q6 partially defining the segmental closed area R5 have been checked in the processing up to the present moment, no unchecked self-intersecting point concerned is extracted in step S607.

The determination in step S608 is NO because no self-intersecting point was extracted in step S607. The operation then jumps to step S613.

In step S613, it is determined whether the current area and the segmental closed area having the stitching end point are one and the same area. In the present stage, the current area R5 is not the same as the segmental closed area R6 having the stitching end point E, so that the determination in step S613 is NO. The operation then proceeds to step S614.

In step S614, the segmental closed area set as an area superior to the current area is set as a new current area. In the present stage, the segmental closed area R6, which has been set as an area superior to the current area R5, is set as a new current area. The operation then returns to step S607.

Since the self-intersecting point Q5 is the only one self-intersecting point partially defining the segmental closed area R6 and has been checked in the processing up to the present moment, no unchecked self-intersecting point concerned is extracted in step S607.

The determination in step S608 is NO because no self-intersecting point was extracted in step S607. The operation then jumps to step S613.

In step S613, it is determined whether the current area and the segmental closed area having the stitching end point are one and the same area. In the present stage, the current area R6 is the same as the segmental closed area R6 having the stitching end point E, so that the determination in step S613 is YES. The operation then goes to step S9 in FIG. 3.

The connecting relationship among the segmental closed areas as indicated in FIG. 5B is constructed by the operation of steps S601–S614. The storage structure of the connection relationship in the RAM 13 is indicated in FIG. 12.

In step S9 in FIG. 3, the segmental closed area that includes the stitching start point S pre-set by the user is specified. In the example shown in FIG. 4A, the stitching start point S is present on the segmental outline defining the segmental closed area U2, the segmental closed area U2 is specified. The current point for stitching is set to the stitching start point S.

In step S10, a segmental closed area that can be stitched is specified. That is, a segmental closed area having only one self-intersecting point of the outline L is specified. In this specifying operation, the stitching end point E is treated as a self-intersecting point. In the example shown in FIG. 4A, the segmental closed area U1 has one self-intersecting point (that is, P1), and the segmental closed area U2 has two self-intersecting points (that is, P2 and P3), and the segmental closed area U3 has two self-intersecting points (that is, P2 and the stitching end point E). Therefore, the segmental closed area U1 is specified as a stitchable segmental closed area. In some cases, a plurality of segmental closed areas can be determined as stitchable areas depending on the total number N of segmental closed areas, the position of the stitching end point E and the like. In such cases, any one of the segmental closed areas considered to be stitchable may be specified as a stitchable area. For example, the first segmental closed area to be determined as a stitchable area may be specified.

In step S11, the self-intersecting point present on the segmental outline of the specified segmental closed area is set as a segmental stitching start point or a segmental stitching end point for the segmental closed area. The content of the operation of step S11 will be described in detail with reference to FIG. 6.

In step S91, it is determined whether the segmental closed area specified as a stitchable area in step S10 includes the stitching end point E. In the example shown in FIG. 4A, the segmental closed area U1 does not include the stitching end point E, so that the determination in step S91 is NO. The operation then goes to step S93, where the valid self-intersecting point P1 present on the segmental outline of the segmental closed area U1 is set as a segmental stitching end point for the segmental closed area U1.

In step S94, it is determined whether the stitching current point, which is presently the stitching start point S, is present on the segmental outline of the segmental closed area U1. Since the stitching start point S is not present on the segmental outline of the segmental closed area U1, the determination in step S94 is also NO. The operation then proceeds to step S95, where the valid self-intersecting point P1 present on the segmental outline of the segmental closed area U1 is set as a segmental stitching start point for the segmental closed area U1. The setting of segmental stitching start and end points for the segmental closed area U1 is completed by the processing described above. In short, if the current point for stitching is not present on the segmental outline of the segmental closed area specified as a stitchable area, the stitching start point and the stitching end point for the segmental closed area are set to the same point by the processing. The operation then proceeds to step S12 shown in FIG. 3.

In step S12, data for running stitches from the current stitching point to the segmental stitching start point of the segmental closed area specified as a stitchable area in step S10 is generated on the basis of the segmental closed area connecting relationship constructed and stored in step S10. The operation of step S12 will be described in detail with reference to the flowchart of FIG. 7, in conjunction with the example shown in FIG. 5A, wherein the segmental closed areas R1–R7 are provided. Let it be assumed that the connecting relationship as indicated in FIG. 5B is constructed in step S8 and the segmental closed area R1 is specified as a stitchable area in step S9. In step S101, a route from the current stitching point, which is currently the stitching start point S present on the segmental outline of the segmental closed area R5, to the segmental closed area R1 is generated. That is, a route R5-R4-R2-R1 is generated.

Figure 13:
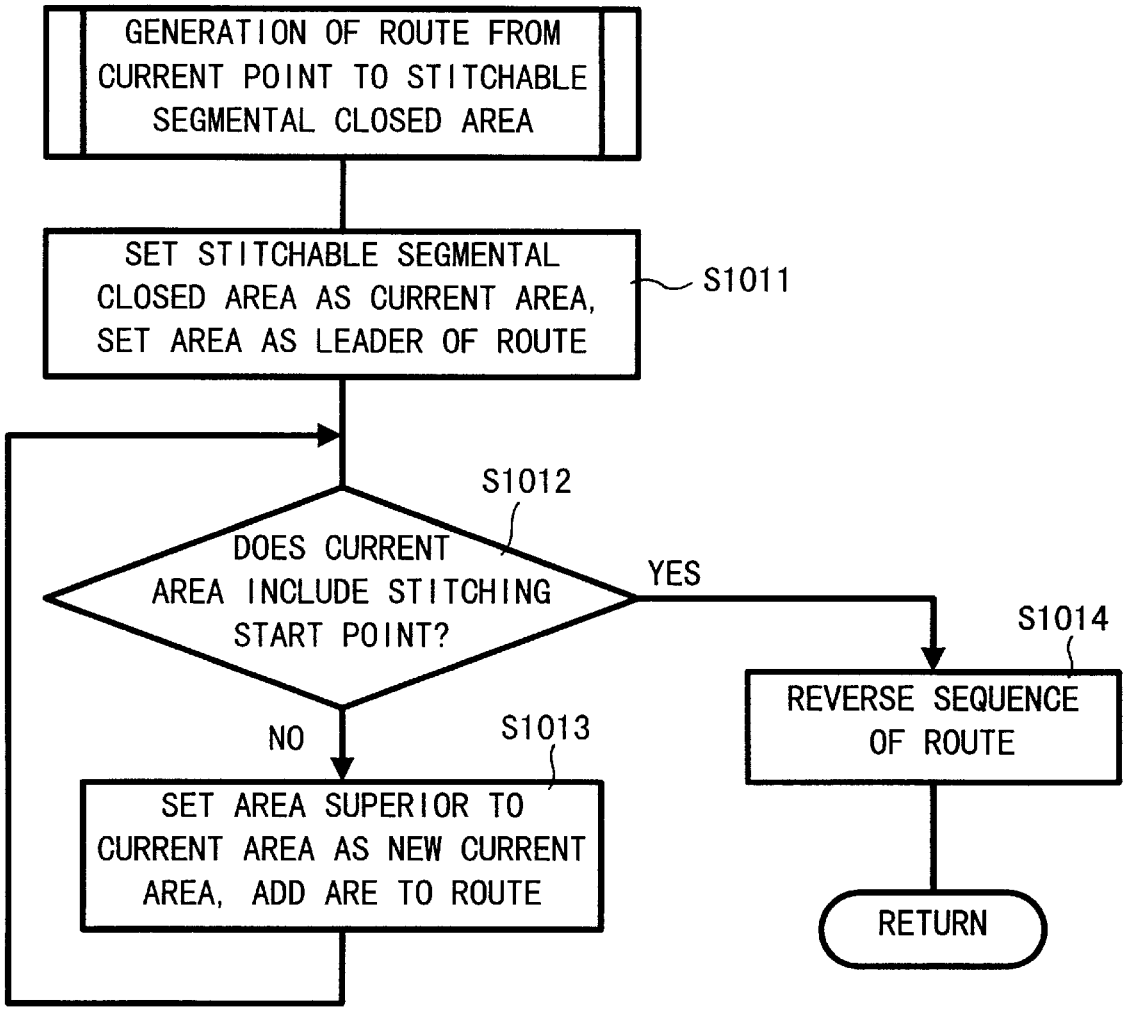
FIG. 13 is a flowchart illustrating an operation of generating a route from a current point to a stitchable segmental closed area.

The operation of generating a route from the current point to a stitchable segmental closed area in step S101 will be described in detail with reference to the flowchart of FIG. 13.

In step S1011, the stitchable segmental closed area is set as a current area, and as a leading area of the route. In the example shown in FIGS. 5A–5C, the segmental closed area R1 specified as a stitchable segmental closed area is set as a current area and a leading area of the route.

In step S1012, it is determined whether the current area includes the stitching start point. In the present stage, the stitching start point S is not present on the segmental outline of the current area, so that the determination in step S1012 is NO. The operation then proceeds to step S1013.

In step S1013, the area superior to the current area is set as a new current area, and added to the route. In the present stage, the segmental closed area R2, superior to the current area R1, is set as a new current area and added to the route. The operation then returns to step S1012.

Because the current area R2 does not include the stitching start point S, the determination in step S1012 is NO, so that the operation proceeds to step S1013.

In step S1013, the segmental closed area R4, superior to the current area R2, is set as a new current area and added to the route. The operation then returns to step S1012.

Because the current area R4 does not include the stitching start point S, the determination in step S1012 is NO, so that the operation proceeds to step S1013.

In step S1013, the segmental closed area R5, superior to the current area R4, is set as a new current area and added to the route. The operation then returns to step S1012.

Because the current area R5 includes the stitching start point S, the determination in step S1012 is YES, so that the operation goes to step S1014.

In step S1014, the sequence of the route is reversed. That is, by reversing the route generated by the processing before step S1014 is R1–R2–R4–R5, the route R5-R4-R2-R1 from the segmental closed area R5 having the stitching start point S to the segmental closed area specified as a stitchable area is generated. After that, the operation proceeds to step S102 in FIG. 7.

In step S102, the number of the segmental closed areas on the route generated in step S101 is counted, and set as a number T of segmental closed areas. In the example shown in FIGS. 5A–5C, the number T is set to four or in FIGS. 4A–4D, the number T is set to two.

In step S103, the value of a counter t for counting the number of segmental closed areas processed along the route is initialized to 1.

In step S104, running stitch data is generated for running stitches that extend from the current stitching point to a connecting point at which the segmental closed area where the current stitching point exists connects to the next segmental closed area along the route, through the interior of the segmental closed area where the current stitching point exists. That is, running stitch data is generated, as indicated in FIG. 5C, for running stitches that extend from the stitching start point S, which is the current stitching point, to the connecting point at which the current stitching point-carrying segmental closed area R5 connects to the next segmental closed area R4 along the route, that is, the self-intersecting point Q4, through the interior of the segmental closed area R5. The current stitching point is updated to the self-intersecting point Q4. The running stitch data may be generated as data for running stitches that extend from the stitching start point S to the self-intersecting point Q4, by any route that does not extend out of the segmental closed area Q5.

The current position sequentially updated on the basis of the route determined in step S101 and the connection information stored in step S8 (as indicated in FIG. 12).

Figure 15A:
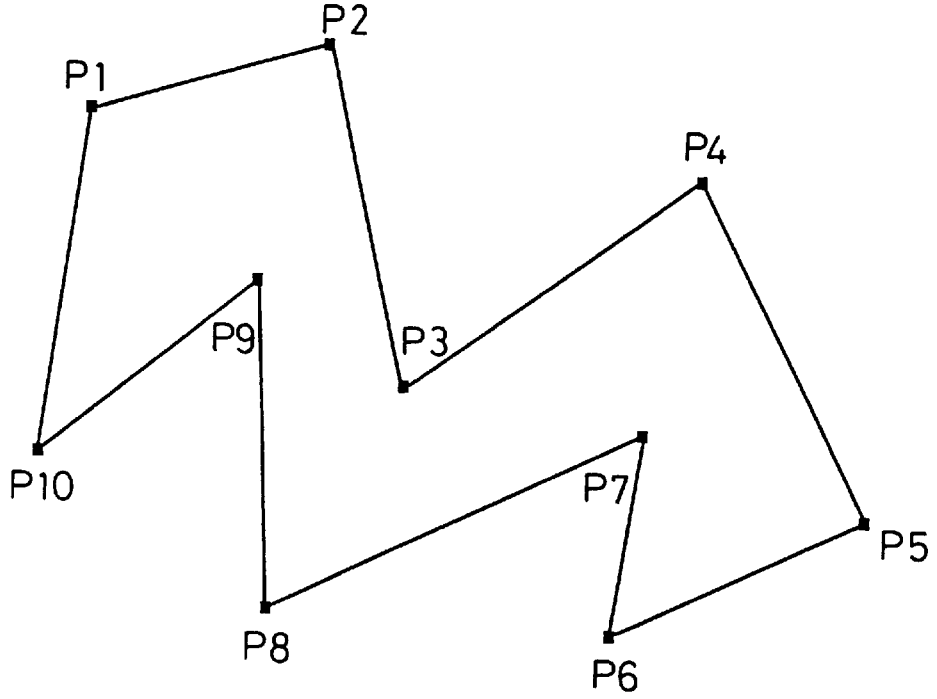
FIGS. 15A and 15B illustrate how a running stitch route is determined in a segmental closed area.
Figure 15B:
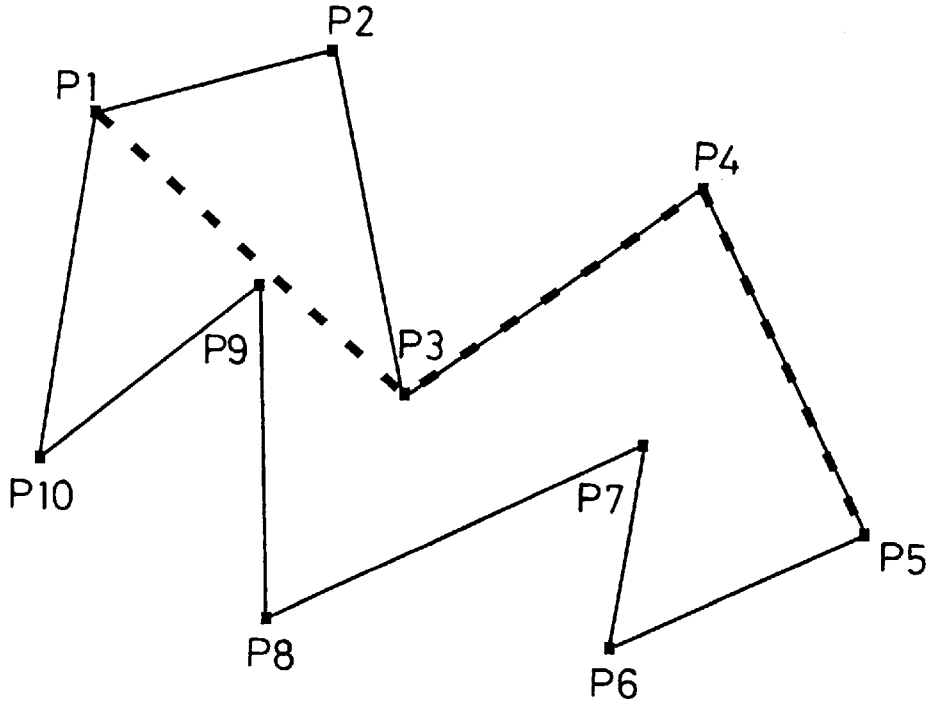
Figure 16:
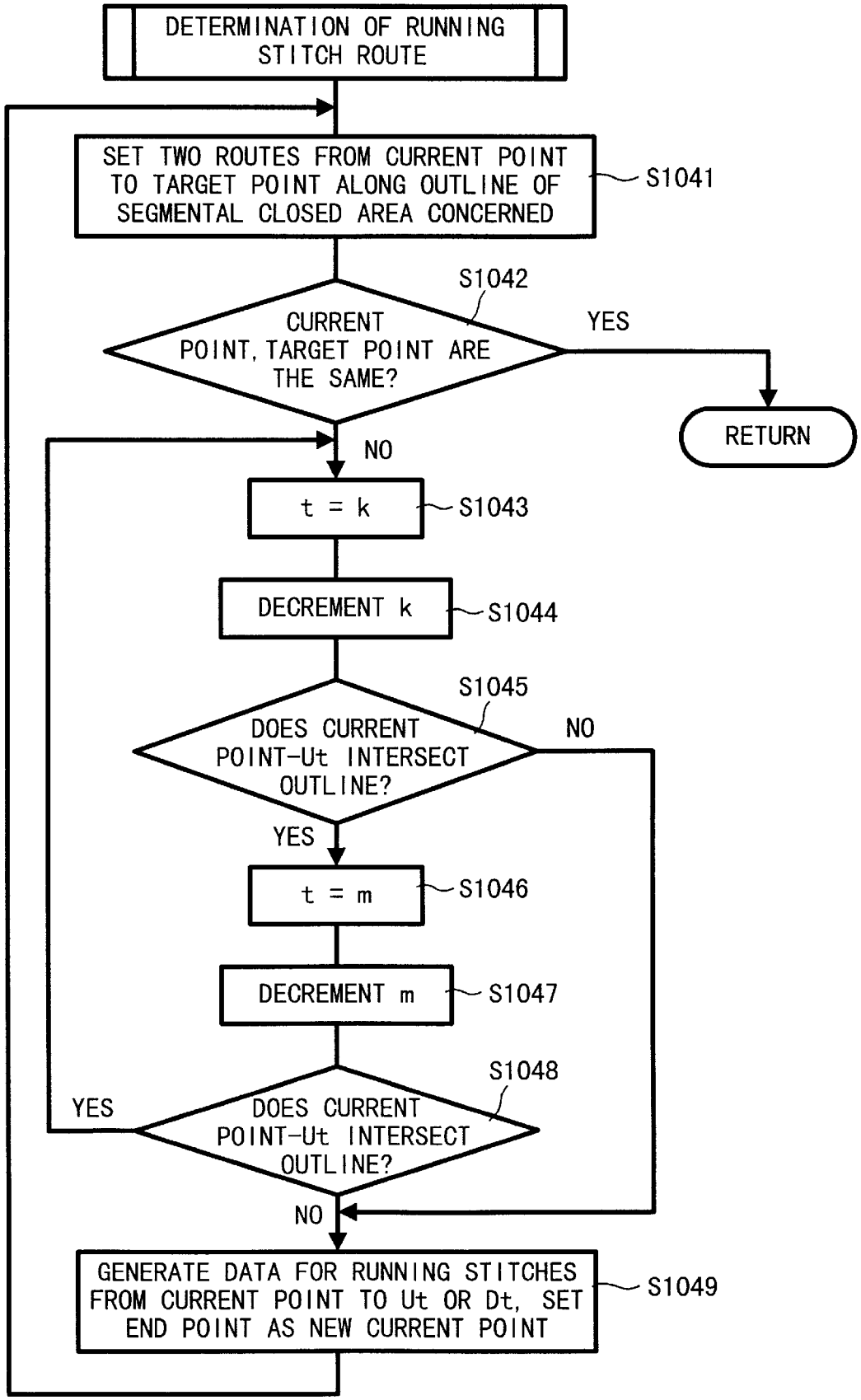
FIG. 16 is a flowchart illustrating an operation of determining a running stitch route.

The operation of determining a running stitch route will be described in detail with reference to the flowchart of FIG. 16, in conjunction with an example case shown in FIGS. 15A and 15B, wherein a pattern is provided with a current point P1 and a target point P5.

In step S1041, two routes from the current point to the target point are set. In the example shown in FIGS. 15A–15B, two routes from P1 to P5 are set, that is, a first route U is set as P1–P2–P3–P4–P5, and a second route D is set as P1-P10-P9-P8-P7-P6-P5. The number k of points that define the first route U is set as 5, and the number m of points that define the second route D is set as 7.

In step S1042, it is determined whether the current point and the target point are one and the same point. Since the current point P1 is not the same as the target point P5 in the example, the determination in step S1042 is NO, so that the operation proceeds to step S1043.

In step S1043, the number k of points defining the first route U is set in the counter t (t=5).

In step S1044, the number k is decremented (k=4).

In step S1045, it is determined whether the line segment connecting the current point and a point Ut on the first route U intersects the outline. Points U1, U2, U3, U4 and U5 correspond to the points P1, P2, P3, P4 and P5. That is, in the example shown in FIGS. 15A and 15B, it is determined in step S1045 whether the line segment connecting the current point P1 and the point U5 (that is, the point P5) intersects the outline. Since the line segment P1–U5 intersects the line segments P2–P3 and P3–P4 that constitute the outline, the determination in step S1045 is YES. The operation then proceeds to step S1046.

In step S1046, the number m of points defining the second route D is set in the counter t (t=7).

In step S1047, the number m is decremented (m=6).

In step S1048, it is determined whether the line segment connecting the current point and a current point Dt on the second route D intersects the outline. Points D1, D2, D3, D4, D5, D6 and D7 correspond to the points P1, P10, P9, P8, P7, P6 and P5. That is, it is determined in step S1048 whether the line segment connecting the current point P1 and the point D7 (that is, the point P5) intersects the outline. Since the line segment P1-D7 intersects the line segments P2–P3 and P3–P4 constituting the outline, the determination in step S1045 is YES. The operation then returns to step S1043.

In step S1043, the number k is set into the counter t (t=4).

In step S1044, the number k is decremented (k=3).

In step S1045, it is determined whether the line segment connecting the current point P1 and the point U4 (that is, the point P4) intersects the outline. Since the line segment P1–U4 intersects the line segment P2–P3 constituting the outline, the determination in step S1045 is YES, so that the operation proceeds to step S1046.

In step S1046, the number m is set in the counter t (t=6).

In step S1044, the number m is decremented (m=5).

In step S1048, it is determined whether the line segment connecting the current point P1 and the point D6 (that is, the point P6) intersects the outline. Since the line segment P1-D6 intersects the line segment P7–P8 constituting the outline, the determination in step S1045 is YES, so that the operation returns to step S1043.

In step S1043, the number k is set into the counter t (t=3).

In step S1044, the number k is decremented (k=2).

In step S1045, it is determined whether the line segment connecting the current point P1 and the point U3 (that is, the point P3) intersects the outline. Since the line segment P1–U3 does not intersect the outline, the determination in step S1045 is NO. The operation then jumps to step S1049.

In step S1049, a running stitch route is determined along the line segment P1–P3 checked for absence of intersection with the outline in step S1045 immediately before, and the end point P3 of the route is set as a new current point. The operation then returns to step S1041.

In step S1041, two routes from the current point P3 to the target point P5 are set. That is, a first route U from P3 to P5 is set as P3–P4–P5, and a second route D is set as P3-P2-P1-P10-P9-P8-P7-P6-P5. The number k of points that define the first route U is set as 3, and the number m of points that define the second route D is set as 9.

As the current point P3 is not the same as the target point P5, the determination in step S1042 is NO, so that the operation proceeds to step S1043.

In step S1043, the number k of points defining the first route U is set in the counter t (t=3).

In step S1044, the number k is decremented (k=2).

In step S1045, it is determined whether the line segment connecting the current point and a point Ut on the first route U intersects the outline. Points U1, U2 and U3 correspond to the points P3, P4 and P5. That is, in the present stage, it is determined whether the line segment connecting the current point P3 and the point U3 (that is, the point P5) intersects the outline. Since the line segment P3–U3 intersects the line segments P7–P8 and P6–P7 constituting the outline, the determination in step S1045 is YES, so that the operation proceeds to step S1046.

In step S1046, the number m of points defining the second route D is set in the counter t (t=9).

In step S1047, the number m is decremented (m=8).

In step S1048, it is determined whether the line segment connecting the current point and a current point Dt on the second route D intersects the outline. Points D1, D2, D3, D4, D5, D6, D7, D8 and D9 correspond to the points P3, P2, P1, P10, P9, P8, P7, P6 and P5. That is, it is determined whether the line segment connecting the current point P3 and the point D9 (that is, the point P5) intersects the outline. Since the line segment P3-D9 intersects the line segments P7–P8 and P6–P7 constituting the outline, the determination in step S1045 is YES, so that the operation returns to step S1043.

In step S1043, the number k is set into the counter t (t =2).

In step S1044, the number k is decremented (k=1).

In step S1045, it is determined whether the line segment connecting the current point P3 and the point U2 (that is, the point P4) intersects the outline. Since the line segment P3–U2 does not intersect the outline, the determination in step S1045 is NO, so that the operation jumps to step S1049.

In step S1049, a running stitch route is determined along the line segment P3–P4 checked for absence of intersection with the outline in step S1045 immediately before, and the end point P4 of the route is set as a new current point. The operation then returns to step S1041.

Subsequently, similar processing is repeated until the final running stitch route P–P3–P4–P5 is established. When the current point becomes the same as the target point, the determination in step S1042 is YES, and the operation goes to step S105 of FIG. 7.

Figure 7:
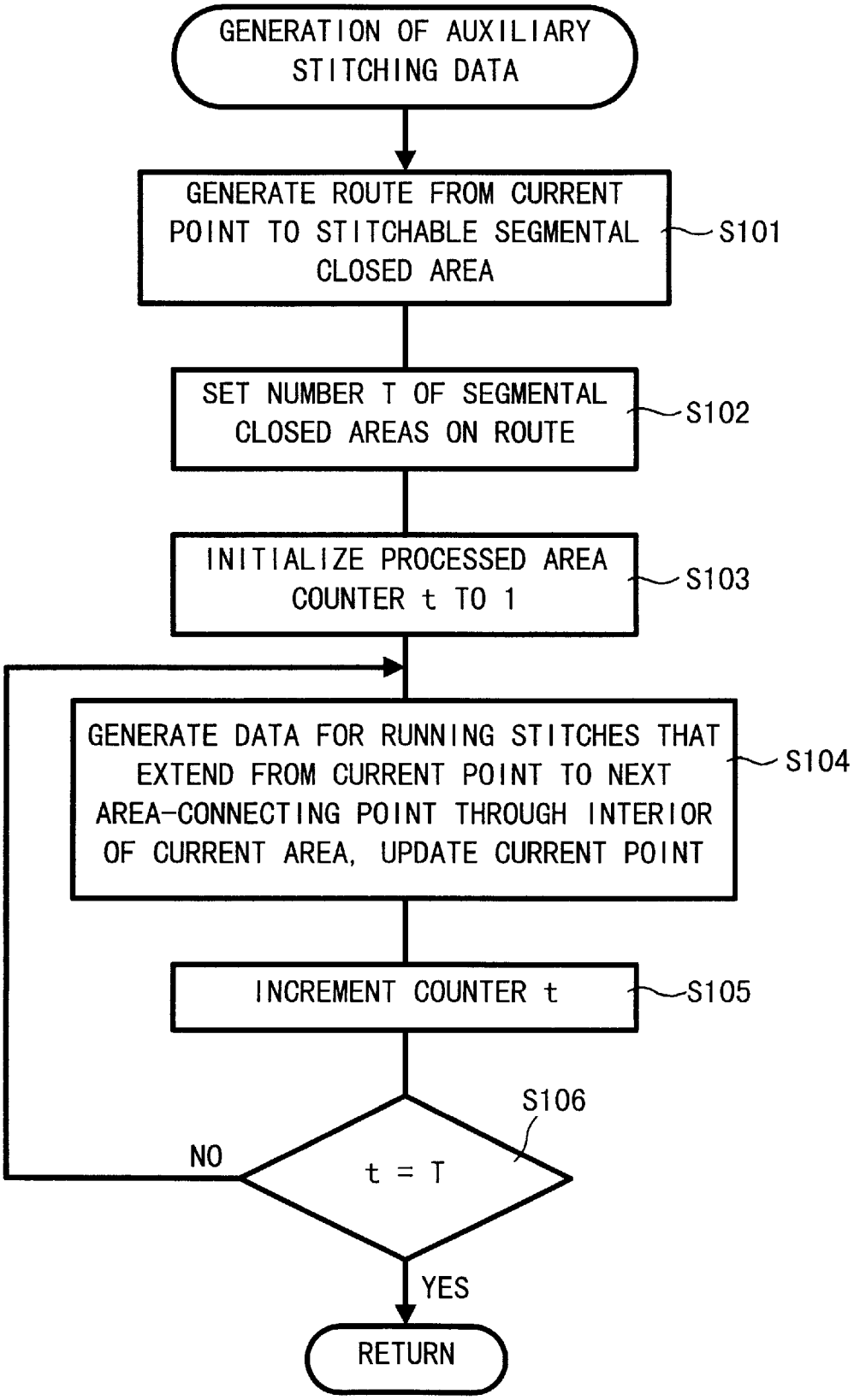
FIG. 7 is a flowchart illustrating an operation of generating auxiliary stitch data in the embodiment.

In step S105 of FIG. 7, the value of the counter t for counting the number of segmental closed areas processed along the route is incremented (t=2).

In step S106, it is determined whether the value of the counter t equals the total number T of segmental closed areas on the route. Because the present counter value t (=2) does not equal the total number T (=4) of segmental closed areas on the route, the determination in step S106 is NO, and the operation returns to step S104.

In step S104, running stitch data is generated for running stitches that extend from the current stitching point, which is presently the self-intersecting point Q4, to the connecting point, that is, the self-intersecting point Q2, at which the current stitching point-carrying segmental closed area R4 connects to the next. segmental closed area R2 along the route generated in step S101, through the interior of the segmental closed area R4. The current stitching point is updated to the self-intersecting point Q2.

In step S105, the value of the counter t for counting the number of segmental closed areas processed along the route is incremented (t=3).

In step S106, it is determined that the counter value t (=3) does not equal the total number T (=4) of segmental closed areas on the route. The operation then returns to step S104.

In step S104, running stitch data is generated for running stitches that extend from the current stitching point, which is presently the self-intersecting point Q2, to the connecting point, that is, the self-intersecting point Q1, at which the current stitching point-carrying segmental closed area R2 connects to the next segmental closed area R1 along the route generated in step S101, through the interior of the segmental closed area R2. The current stitching point is updated to the self-intersecting point Q1.

In step S105, the value of the counter t for counting the number of segmental closed areas processed along the route is incremented (t=4).

In step S106, it is determined that the counter value t (=4) equals the total number T (=4) of segmental closed areas on the route. The generation of data for running stitches that extend from the stitching start point S to the segmental closed area R1 specified as a stitchable area is thus completed.

Figure 4B:
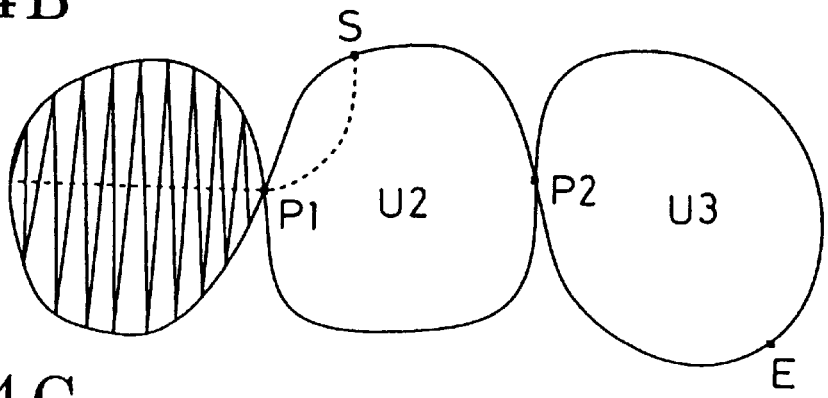

For the case shown in FIG. 4A, running stitch data is generated for running stitches that extend from the stitching start point S, which is the current stitching point, to the segmental stitching start point P1 of the segmental closed area U1 specified in step S10. Since the segmental closed area U2 carrying the stitching start point S and the segmental closed area U1 specified as a stitchable area are interconnected by the self-intersecting point P1 with no segmental closed area enroute therebetween, data for running stitches from the stitching start point S to the self-intersecting point P1 as shown in FIG. 4B is generated. Then the current stitching point P1 is updated, and the operation returns to step S12 in FIG. 3.

In step S13, segmental stitch data for filling the interior of the segmental closed area U1 is generated. Segmental stitch data is generated on the basis of the setting made in step S11, that is, with the stitching start and end points being set to the self-intersecting point P1, by employing a known method of generating data for stitching inside a closed area. Then the current stitching point is set to the self-intersecting point P1 again. Data for running stitches and stitches filling the interior of the segmental closed area U1 that is generated by the processing up to the present stage is schematically indicated in FIG. 4B.

In step S14, the management flag of the self-intersecting point P1 on the segmental outline defining the segmental closed area U1, for which segmental stitch data has been generated, is set to "INVALID" in order to exclude the self-intersecting point P1 from the counting of self-intersecting points during the operation of specifying a stitchable segmental closed area in step S10. Based on the invalid setting of the management flag, the subsequent operation of specifying a stitchable segmental closed area is performed.

In step S15, the segmental closed area counter n (=0) is incremented (to n=1).

In step S16, it is determined whether the value of the segmental closed area counter n (=1) equals the total number N (=3) of segmental closed areas. In the present stage, the determination in step S16 is NO, and the operation returns to step S10.

In step S10, a stitchable segmental closed area is specified, with the setting of the management flag of the self-intersecting point P1 made in step S12 being taken into consideration. In this step, the segmental closed areas U2, U3, for which segmental stitch data has not been generated, are examined. That is, although the segmental closed area U2 carries two self intersecting points, that is, P1 and P2, it is determined that the valid self-intersecting point is only the point P2 because the self-intersecting point P1 has been set to "INVALID" in step S14 and therefore excluded form the counting. On the other hand, the segmental closed area U3 carries the self-intersecting point P2 and the stitching end point E (which is regarded as a self-intersecting point in this operation). Therefore, the segmental closed area U2 is specified as the next stitchable segmental closed area.

In step S11, the self-intersecting points P1, P2 present on the segmental outline of the specified segmental closed area U2 are set as a segmental stitching start point or a segmental stitching end point for the segmental closed area. This operation will be described with reference to the flowchart of FIG. 6.

In step S91, it is determined that the stitching end point E is not present on the segmental closed area U2. The operation then proceeds to step S93.

In step S93, the valid self-intersecting point P2 on the segmental closed area U2 is set as a segmental stitching end point.

In step S94, it is determined that the current point, which is presently the self-intersecting point P1, is on the segmental closed area U2. The operation then proceeds to step S96.

In step S96, the current stitching point, which is the self-intersecting point P1, is set as a segmental stitching start point for the segmental closed area U2. The operation then proceeds to step S10 in FIG. 3.

In step S12, data for running stitches from the current stitching point, which is the self-intersecting point P1, to the segmental stitching start point P1 of the segmental closed area U2 specified as a stitchable area in step S10 is generated. However, because the current stitching point (P1) and the segmental stitching start point (P1) of the segmental closed area U2 are the same point, no substantial running stitch data is generated. Then the current stitching point is updated to the self-intersecting point P1 again, and the operation proceeds to step S13 in FIG. 3.

Figure 4C:
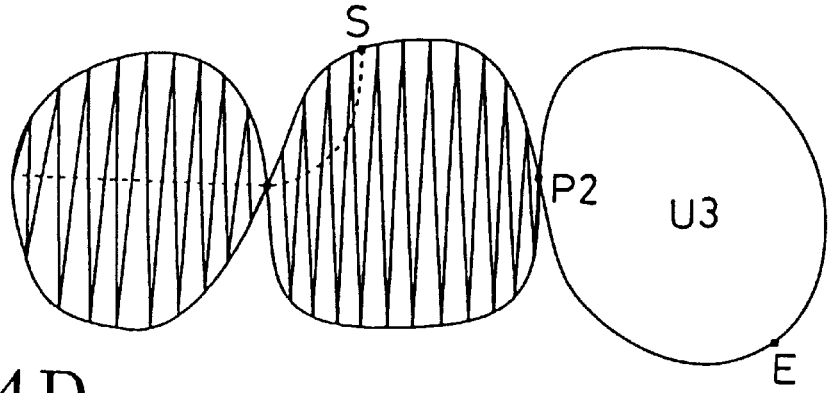

In step S13, segmental stitch data for filling the interior of the segmental closed area U2 is generated. Segmental stitch data is generated on the basis of the setting made in step S11, that is, with the segmental stitching start point and the segmental stitching end point being set to the self-intersecting points P1 and P2, respectively. Then the current stitching point is set to the self-intersecting point P1 again. Data generated by the processing up to the present stage is schematically indicated in FIG. 4C.

In step S14, the management flag of the valid self-intersecting point P2 on the segmental outline defining the segmental closed area U2, for which segmental stitch data has been generated, is set to "INVALID" in order to exclude the self-intersecting point P2 from the counting of self-intersecting points during the operation of specifying a stitchable segmental closed area in step S10. Based on the invalid setting, the subsequent operation of specifying a stitchable segmental closed area is performed.

In step S15, the segmental closed area counter n (=1) is incremented (to n=2).

In step S16, it is determined whether the value of the segmental closed area counter n (=2) equals the total number N (=3) of segmental closed areas. In the present stage, the determination in step S16 is NO, and the operation returns to step S10.

In step S10, a stitchable segmental closed area is specified, with the setting of the management flag of the self-intersecting point P2 in step S12 being taken into consideration. That is, although the segmental closed area U3, for which segmental stitch data has not been generated, carries the self-intersecting point P2 and the stitching end point E (which is regarded as a self-intersecting point in this operation), it is determined that the valid self-intersecting point is only the stitching end point E because the self-intersecting point P2 has been set to "INVALID" in step S14 and therefore excluded from the counting. Therefore, the segmental closed area U3 is specified as the next stitchable segmental closed area.

In step S11, the self-intersecting point P2 and the stitching end point E present on the segmental outline of the specified segmental closed area U3 are set as a segmental stitching start point or a segmental stitching end point for the segmental closed area.

Figure 6:
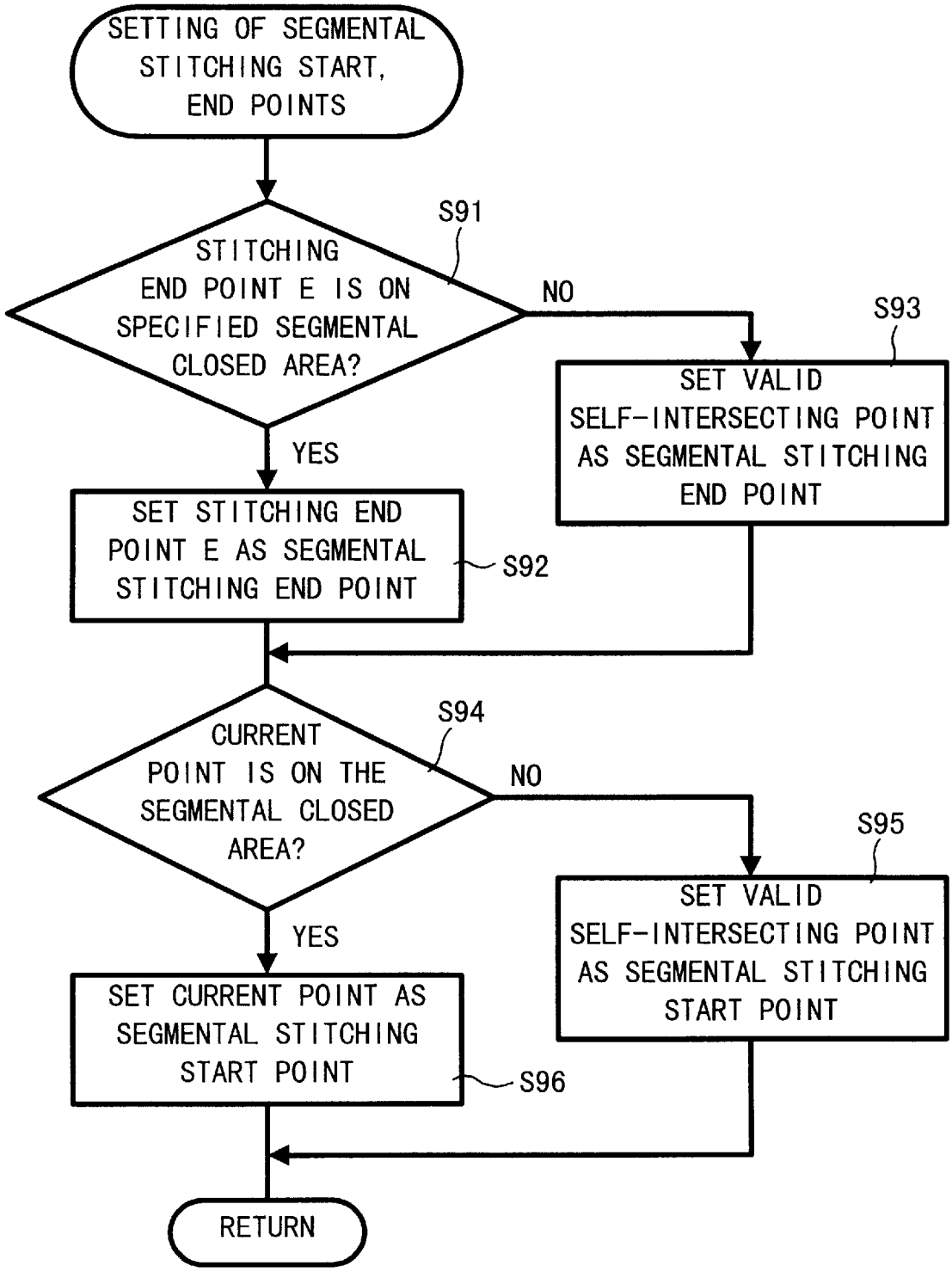
FIG. 6 is a flowchart illustrating an operation of setting segmental stitching start and end points in the embodiment.

In step S91 in the flowchart of FIG. 6, it is determined that the stitching end point E is present on the segmental closed area U3. The operation then proceeds to step S92.

In step S92, the stitching end point E is set as the segmental stitching end point for the segmental closed area U3.

In step S94, it is determined that the current point, which is the self-intersecting point P2, is present on the segmental closed area U3 specified as a stitchable area. The operation then proceeds to step S96.

In step S96, the self-intersecting point P2 is set as a segmental stitching start point for the segmental closed area U3. The operation then proceeds to step S12 in FIG. 3.

In step S12, data for running stitches from the current stitching point, which is the self-intersecting point P2, to the segmental stitching start point P2 of the segmental closed area U3 specified as a stitchable area in step S10 is generated. However, because the current stitching point (P2) and the segmental stitching start point (P2) of the segmental closed area U3 are the same point, no substantial running stitch data is generated. Then the current stitching point is updated to the self-intersecting point P2 again, and the operation proceeds to step S13 in FIG. 3.

Figure 4D:
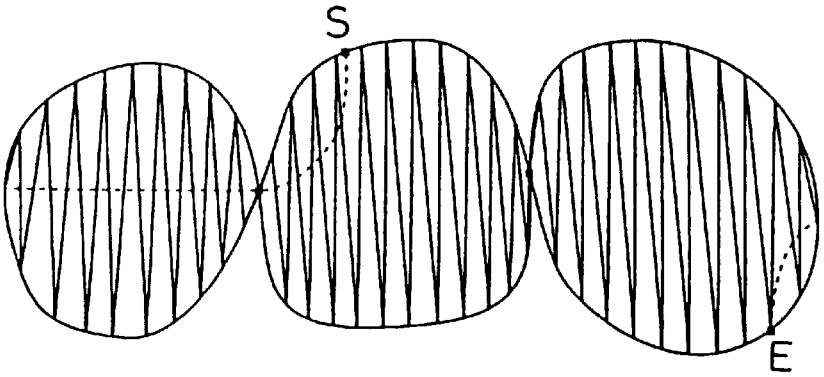

In step S13, segmental stitch data for filling the interior of the segmental closed area U3 is generated. Segmental stitch data is generated on the basis of the setting made in step S11, that is, with the segmental stitching start point and the segmental stitching end point being set to the self-intersecting point P2 and the stitching end point E, respectively, that is, segmental stitches are generated for the segment with one stitch point being end point E. A running stitch then goes to the final generated stitch point in the segment and the embroidery stitching then is done back to end point E. Such stitching is described in U.S. Pat. No. 5,576,968 the disclosure of which is incorporated by reference herein. Data generated by the processing up to the present stage is schematically indicated in FIG. 4D.

In step S14, no substantial processing is performed since there is no valid self-intersecting point left on the segmental closed area U3, for which segmental stitch data has been generated.

In step S15, the segmental closed area counter n (=2) is incremented (to n=3).

In step S16, it is determined whether the value of the segmental closed area counter n (=3) equals the total number N (=3) of segmental closed areas. In the present stage, it is determined that they equal each other. The operation of generating stitch data is thus completed.

The stitch data thus generated is transmitted to the embroidery sewing machine 25, via the output interface 18 and the communication cable 20 shown in FIG. 2, and then used for embroidery stitching by the embroidery sewing machine 25.

In this embodiment, the outline L is divided at the self-intersecting points P1 and P2 into a plurality of segmental outlines by the operation in step S4. The connecting relationship among the segmental closed areas enclosed by the segmental outlines is determined and stored by the operation in step S8. Of the segmental closed areas, a stitchable segmental area is sequentially specified by the operation in step S10. The self-intersecting points P1, P2 of the outline L are set as the segmental stitching start point or the segmental stitching end point of the individual segmental closed areas by the operation in step S11. Running stitch data is generated as auxiliary stitch data for continuously stitching the segmental closed areas by the operation in step S12. Segmental stitch data is generated with respect to each of the segmental closed areas enclosed by the segmental outlines in the operation in step S13. Therefore, it becomes possible to generate stitch data whereby the segmental closed areas are continuously stitched in a short time in an efficient sequence, without allowing a stitch or thread to extend out of the embroidery area, even if the outline L intersects itself.

In this embodiment, the operation in step S4 performs the function of a dividing device. The operation in step S8 performs the function of a storage device. The operation in step S10 performs the function of a stitching sequence determining device. The operation in step S11 performs the function of a setting device. The operation in step S12 performs the function of an auxiliary stitch data generating device. The operation in step S13 performs the function of a segmental stitch data generating device.

Although, in the foregoing embodiment, the embroidery data processing apparatus generates stitch data, and outputs the data to the embroidery sewing machine, it is also possible to employ an arrangement wherein the embroidery data processing apparatus generates data regarding outlines, stitching characteristics, and the like and outputs the data to the embroidery machine, which generates stitch data based on the data from the embroidery data processing apparatus.

As apparent from the foregoing description, according to the invention, if an outline defining the external shape of an embroidery area has a self-intersecting portion, the dividing device divides the outline into a plurality of segmental outlines using the self-intersecting portion as a boundary. For each of the segmental closed areas defined by the segmental outlines, the segmental stitch data generating device generates segmental stitch data. Therefore, even if the underlying stitch area outline intersects itself and defines a plurality of segmental closed areas, it is possible to easily generate stitch data whereby the segmental closed areas of an embroidery area are stitched without allowing a stitch or thread to extend out of the embroidery area, because stitch data is generated separately for the individual segmental closed areas.

In the preferred embodiment of the invention, the embroidery data processing apparatus further includes a setting device that sets a point at which the outline intersects itself, as a stitching start point or a stitching end point for the individual segmental closed areas. This optional arrangement further facilitates generation of stitch data that achieves efficient stitching of the segmental closed areas without allowing a stitch or thread to extend out of the embroidery area.

In the preferred embodiment, the embroidery data processing apparatus further includes a stitching sequence determining device that determines a stitching sequence of the segmental closed areas. Therefore, it becomes possible to generate stitch data for stitching the segmental closed areas in an efficient stitching sequence.

In the preferred embodiment, the embroidery data processing apparatus further includes an auxiliary stitch data generating device that generates auxiliary stitch data for continuously stitching the segmental closed areas. Therefore, it becomes possible to generate stitch data for continuously and efficiently stitching the segmental closed areas without allowing a stitch or thread to extend out of the embroidery area.

In the preferred embodiment, the embroidery data processing apparatus further includes a storage device that stores a connecting relationship between the segmental closed areas. Based on the connecting relationship between the segmental closed areas that is stored by the storage device, the auxiliary stitch data generating device generates auxiliary stitch data. This optional arrangement efficiently generates auxiliary stitching data for connecting two segmental closed areas that are not contiguous to each other, without allowing a stitch or thread to extend out of the embroidery area.

In the preferred embodiment, the auxiliary stitch data generated by the auxiliary stitch data generating device includes data regarding running stitches that extend at a given pitch through a point at which the outline intersects itself. Therefore, it becomes possible to generate auxiliary stitch data for continuously stitching segmental closed areas, in the form of feed stitch (generally termed jump stitch) data or running stitch data whereby stitching extends at an appropriate pitch through a self-intersecting point of the outline.

It is to be understood that the invention is not restricted to the particular forms shown in the foregoing embodiment. Various modifications and alternations can be made thereto without departing from the scope of the invention encompassed by the appended claims.

What is claimed is:

1. An embroidery data processing apparatus for processing embroidery data for filling a closed area, enclosed by a continuous outline that defines a shape of an embroidery area, with stitches, comprising:

a dividing device that, if the continuous outline has a point at which the continuous outline intersects itself, called a self-intersecting point, divides the continuous outline into a plurality of segmental outlines using the self-intersecting point as a boundary; and a segmental stitch data generating device that generates segmental stitch data for each of segmental closed areas defined by the plurality of segmental outlines.

2. An embroidery data processing apparatus according to claim 1, further comprising a setting device that sets a point at which the continuous outline intersects itself, as one of a stitching start point and a stitching end point for the individual segmental closed areas.

3. An embroidery data processing apparatus according to claim 1, further comprising a stitching sequence determining device that determines a stitching sequence of the segmental closed areas.

4. An embroidery data processing apparatus according to claim 1, further comprising an auxiliary stitch data generating device that generates auxiliary stitch data for continuously stitching the segmental closed areas.

5. An embroidery data processing apparatus according to claim 4, further comprising a storage device that stores a connecting relationship between the segmental closed areas, the auxiliary stitch data generating device generating the auxiliary stitch data on the basis of the connecting relationship between the segmental closed areas that is stored by the storage device.

6. An embroidery data processing apparatus according to claim 4, wherein the auxiliary stitch data generated by the auxiliary stitch data generating device includes data regarding running stitches that extends at a given pitch through a point at which the continuous outline intersects itself.

7. An embroidery data processing apparatus according to claim 2, further comprising a stitching sequence determining device that determines a stitching sequence of the segmental closed areas.

8. An embroidery data processing apparatus according to claim 2, further comprising an auxiliary stitch data generating device that generates auxiliary stitch data for continuously stitching the segmental closed areas.

9. An embroidery data processing apparatus according to claim 3, further comprising an auxiliary stitch data generating device that generates auxiliary stitch data for continuously stitching the segmental closed areas.

10. An embroidery data processing apparatus according to claim 5, wherein the auxiliary stitch data generated by the auxiliary stitch data generating device includes data regarding running stitches that extends at a given pitch through a point at which the outline intersects itself.

11. An embroidery data creating apparatus for creating embroidery stitch data for a continuous outline which crosses itself to create a plurality of closed areas, the apparatus comprising:

means for determining whether the continuous outline has self-intersecting points;

means for identifying closed areas;

means for establishing a relationship between closed areas;

means for designating a stitch starting point;

means for selecting a first closed area for embroidery stitching;

means for developing a running stitch from the stitch starting point to the first closed area for embroidery stitching; and means for creating embroidery stitches for each closed area of the plurality of closed areas commencing with the first closed area.

12. The apparatus according to claim 11, further comprising:

means for designating outline defining points;

means for establishing line segments between adjacent outline defining points; and means for identifying intersecting line segments, the means for determining whether the continuous outline has self-intersecting points designating each point of intersection as a self-intersecting point.

13. The apparatus according to claim 11, wherein the means for establishing a relationship between closed areas, comprises:

means for designating an end stitch point;

means for identifying an end closed area containing the end stitch point;

wherein the means for determining a self-intersecting point located on a periphery of the closed area, further comprises:

means for establishing two stitch routes from one self-intersecting point on the closed area periphery to a second self-intersecting point on the closed area periphery using the outline defining points;

means for creating line segments from the one self-intersecting point to each outline defining point;

means for identifying a line segment from the one self-intersecting point to an outline defining point on one of the two stitch routes that does not intersect a line segment of the closed area;

means for establishing two new stitch routes from the outline defining point on the one stitch route to the second self-intersecting point;

means for identifying a next line segment from the outline defining point on the one stitch route to a next outline defining point on one of the two new stitch routes that does not intersect a line segment of the closed area containing the end point;

means for identifying a second closed area having the intersecting point on a periphery and designating the second closed area as subordinated to the end closed area; and means for continuing processing until all self-intersecting points have been reviewed and closed areas sharing a self-intersecting point have been placed in a superior-subordinate relationship.

14. The apparatus according to claim 13, wherein the means for creating embroidery stitches further comprises means for using the self-intersecting point on the first closed area as a stitch start point for developing embroidery stitches for the adjacent closed area sharing the self-intersecting point.

15. The apparatus according to claim 11, wherein the means for developing a running stitch to the first closed area includes means for continuing processing in an iterative manner until a stitch route totally within or along the periphery of the closed area is established.

16. A storage medium for storing programs for creating embroidery stitch data for a continuous outline which crosses itself to create a plurality of closed areas, the program comprising:

a program for creating the continuous outline defined by a plurality of outline defining points;

a program for identifying self-intersecting points along the continuous outline where the continuous outline crosses itself;

a program for identifying each closed area created by the self-intersecting points; and a program for creating embroidery stitches for each closed area.

17. The storage medium according to claim 16, further comprising a program for designating a stitch start point and a stitch end point.

18. The storage medium according to claim 17, further comprising a program for establishing a hierarchical relationship between the identified closed areas, a closed area containing the end point being at a top of the hierarchy.

19. The storage medium according to claim 18, further comprising:

a program to select a first closed area for the development of embroidery stitches; and a program for developing a stitch path from the start point to the first closed area.

20. The storage medium according to claim 18, further comprising a program for creating embroidery stitches for each closed area commencing with a closed area most remote from the closed area containing the end point based upon the hierarchical relationship.

* * * * *